US011603996B2

(12) United States Patent
Gagne

(10) Patent No.: US 11,603,996 B2
(45) Date of Patent: Mar. 14, 2023

(54) METHODS AND SYSTEM FOR CONTROLLING A COMBINATION BOILER

(71) Applicant: Lochinvar, LLC, Lebanon, TN (US)

(72) Inventor: Curtis George Gagne, Smyrna, TN (US)

(73) Assignee: Lochinvar, LLC, Lebanon, TN (US)

( * ) Notice: Subject to any disclaimer, the term of this patent is extended or adjusted under 35 U.S.C. 154(b) by 330 days.

(21) Appl. No.: 17/143,206

(22) Filed: Jan. 7, 2021

(65) Prior Publication Data

US 2021/0123610 A1 Apr. 29, 2021

Related U.S. Application Data

(62) Division of application No. 15/265,055, filed on Sep. 14, 2016, now Pat. No. 10,914,475.

(51) Int. Cl.
*F24D 19/10* (2006.01)
*F24D 3/08* (2006.01)

(52) U.S. Cl.
CPC ..... *F24D 19/1069* (2013.01); *F24D 3/08* (2013.01); *F24D 2220/042* (2013.01); *F24D 2220/06* (2013.01); *F24D 2240/10* (2013.01)

(58) Field of Classification Search
None
See application file for complete search history.

(56) References Cited

U.S. PATENT DOCUMENTS 4,463,542 A 8/1984 Greenawalt et al.
5,233,970 A * 8/1993 Harris ..... F24D 3/082 122/15.1
2005/0022542 A1 2/2005 Sakakibara
(Continued)

FOREIGN PATENT DOCUMENTS

CN 102066848 A 5/2011
EP 740113 A1 10/1996
(Continued)

OTHER PUBLICATIONS

Office Action in corresponding China application No. 201780056334.2 (with English translation of office action and search report), dated Apr. 22, 2020, 13 pages (not prior art).
(Continued)

*Primary Examiner* — Steven B McAllister
*Assistant Examiner* — John E Bargero
(74) *Attorney, Agent, or Firm* — Lucian Wayne Beavers; Patterson Intellectual Property Law, PC

(57) ABSTRACT

A combination boiler provides heated water to a boiler loop and domestic hot water (DHW) to a domestic water loop. The combination boiler includes a primary heat exchanger (PHE) connected to the boiler loop and a burner to provide heat to the primary heat exchanger. A secondary heat exchanger (SHE) transfers heat energy from the boiler loop to the domestic water loop. A controller monitors a PHE inlet temperature and a DHW output temperature, obtains a pre-heat initialization temperature threshold and a pre-heat cancellation temperature threshold, and detects a low temperature condition. A pre-heat operation is initiated responsive to the low temperature condition by circulating heated water from the PHE to the SHE. The burner is selectively fired at least in part according to an outlet temperature of the PHE.

8 Claims, 18 Drawing Sheets

(56) References Cited

U.S. PATENT DOCUMENTS

| | | | |
|---|---|---|---|
| 2010/0230088 | A1 | 9/2010 | Clark et al. |
| 2010/0326646 | A1 | 12/2010 | Kim et al. |
| 2011/0259322 | A1 | 10/2011 | Davis et al. |
| 2015/0090199 | A1 | 4/2015 | Min |
| 2015/0338129 | A1 | 11/2015 | Matsuzawa |
| 2016/0265810 | A1 | 9/2016 | Humphrey et al. |
| 2017/0363301 | A1 | 12/2017 | Son et al. |

FOREIGN PATENT DOCUMENTS

| | | | |
|---|---|---|---|
| EP | 940636 | A2 | 9/1999 |
| EP | 2006607 | A2 | 12/2008 |
| EP | 2573471 | A1 | 3/2013 |
| WO | 2005050100 | A2 | 6/2005 |
| WO | 2007058411 | A1 | 5/2007 |
| WO | 2013130701 | A1 | 9/2013 |
| WO | 2015082708 | A1 | 6/2015 |
| WO | 2016145154 | A1 | 9/2016 |

OTHER PUBLICATIONS

European Search Report for corresponding patent application No. EP 17851226, dated Feb. 27, 2020, 6 pages (not prior art).

Canada Office Action for corresponding patent application No. 3031928, dated Dec. 4, 2019, 10 pages (not prior art).

International Search Report for application No. PCT/US2017/042743, dated Nov. 2, 2017, 22 pages (not prior art).

India Office Action for corresponding patent application No. 201917002070, dated Jul. 6, 2020, 6 pages (not prior art).

European Search Report for corresponding 20 21 4270, dated Mar. 22, 2021, 7 pages (not prior art).

* cited by examiner

1600

METHODS AND SYSTEM FOR CONTROLLING A COMBINATION BOILER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a divisional of and claims benefit of the following patent application which is hereby incorporated by reference: Ser. No. 15/265,055 filed Sep. 14, 2016.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to controlling operations of a combination boiler. More particularly, the present invention relates to providing a combination boiler control to reduce an amount of time it takes to reach a desired temperature for a domestic hot water (DHW) demand, to manage low DHW flow draws, and to allow hot water circulation (e.g., recirculation) in a combination boiler system.

Current combination boiler implementations experience difficulty managing the time it takes after a hot water draw is started to supply water at a desired temperature. Combination boilers might rely on a flow switch or a flow sensor to identify when a DHW draw has started and cause the boiler to fire. However, combination boiler flow switches typically have a minimum flow rate that can be detected. In cases where the required DHW flow is less than the minimum setting of the flow switch, the boiler will not fire and there the unit will not provide heated water. Furthermore, when a DHW flow is less than the minimum flow switch setting, typically less heat output is required than the minimum firing rate of the combination boiler burner. Because of the use of thermostatic mixing valves with combination boilers, it is not advisable to implement a hot water circulation system where the full circulation (and/or recirculation) flow passes through a combination boiler. This makes it impractical to achieve flows high enough to trigger a flow switch of the combination boiler.

Providing pre-heat functionality in a combination boiler presents numerous challenges. One such challenge relates to avoiding frequent firing cycles and short run times for a combination boiler, which would otherwise cause problematic thermal cycling of the primary combustion heat exchanger and potentially reduce the lifecycle of the boiler.

Current pre-heat methods used in some combination boilers and on-demand water heaters require either manual or dynamic scheduling. This scheduling, however, is only beneficial if a DHW demand occurs according to the schedule. For example, if a pre-heat method is scheduled at 5:00 A.M., the pre-heat method does not help if a DHW demand occurs at 4:30 A.M. Other pre-heat methodologies rely on firing the boiler at specific time intervals. However, periodic firing does not allow for hot water circulation (and/or recirculation) or low flow DHW draws.

It would therefore be desirable for a combination boiler to provide pre-heat operations to reduce a time to reach a desired set point temperature for a DHW demand, to manage low flow DHW draws, and to allow hot water circulation/recirculation.

BRIEF SUMMARY OF THE INVENTION

An invention as disclosed herein may solve the above described problems by:

In one exemplary embodiment, provided is a combination boiler for providing heated water to a boiler loop and domestic hot water (DHW) to a domestic water loop. The combination boiler includes a primary heat exchanger configured to be connected to the boiler loop and a burner configured to provide heat to the primary heat exchanger. The combination boiler further includes a secondary heat exchanger configured to transfer heat energy from the boiler loop to the domestic water loop. A controller is included as part of the combination boiler. The controller is configured to monitor a primary heat exchanger inlet temperature and a DHW output temperature, to obtain a pre-heat initialization temperature threshold and a pre-heat cancellation temperature threshold, and to detect a low temperature condition when at least one of the primary heat exchanger inlet temperature and the DHW output temperature falls below the pre-heat initialization temperature threshold. The controller is further configured to initiate a pre-heat operation of the combination boiler responsive to a low temperature condition by circulating heated water from the primary heat exchanger to the secondary heat exchanger, and to end the pre-heat operation without firing the burner when both of the primary heat exchanger inlet temperature and the DHW output temperature exceed the pre-heat cancellation temperature threshold.

In another exemplary embodiment, a method is provided for controlling a combination boiler having a primary heat exchanger connected to a boiler loop, a burner configured to provide heat to the primary heat exchanger, and a secondary heat exchanger configured to transfer heat energy from the boiler loop to a domestic water loop. The method begins by storing heated water at the primary heat exchanger, obtaining a pre-heat initialization temperature threshold and a pre-heat cancellation temperature threshold, and monitoring a primary heat exchanger inlet temperature and a domestic hot water (DHW) output temperature. The method includes detecting at least one of the primary heat exchanger inlet temperature and the DHW output temperature falling below the pre-heat initialization temperature threshold, and initiating a pre-heat operation of the combination boiler by circulating the heated water from the primary heat exchanger to the secondary heat exchanger. The method further includes ending the pre-heat operation without firing the burner when both of the primary heat exchanger inlet temperature and the DHW output temperature exceed the pre-heat cancellation temperature threshold.

In a further exemplary embodiment, a method is provided for controlling a combination boiler having a primary heat exchanger connected to a boiler loop, a burner configured to provide heat to the primary heat exchanger, and a secondary heat exchanger configured to transfer heat energy from the boiler loop to a domestic water loop. The method includes storing heated water at the primary heat exchanger, obtaining a pre-heat initialization temperature and a minimum outlet temperature threshold, and monitoring a primary heat exchanger inlet temperature and a domestic hot water (DHW) output temperature. The method continues by detecting at least one of the primary heat exchanger inlet temperature and the DHW output temperature falling below the pre-heat initialization temperature threshold. A pre-heat operation of the combination is initiated by circulating the heated water from the primary heat exchanger to the secondary heat exchanger. An outlet temperature of the primary heat exchanger is monitored, and the burner is fired when the outlet temperature falls below the minimum outlet temperature threshold.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
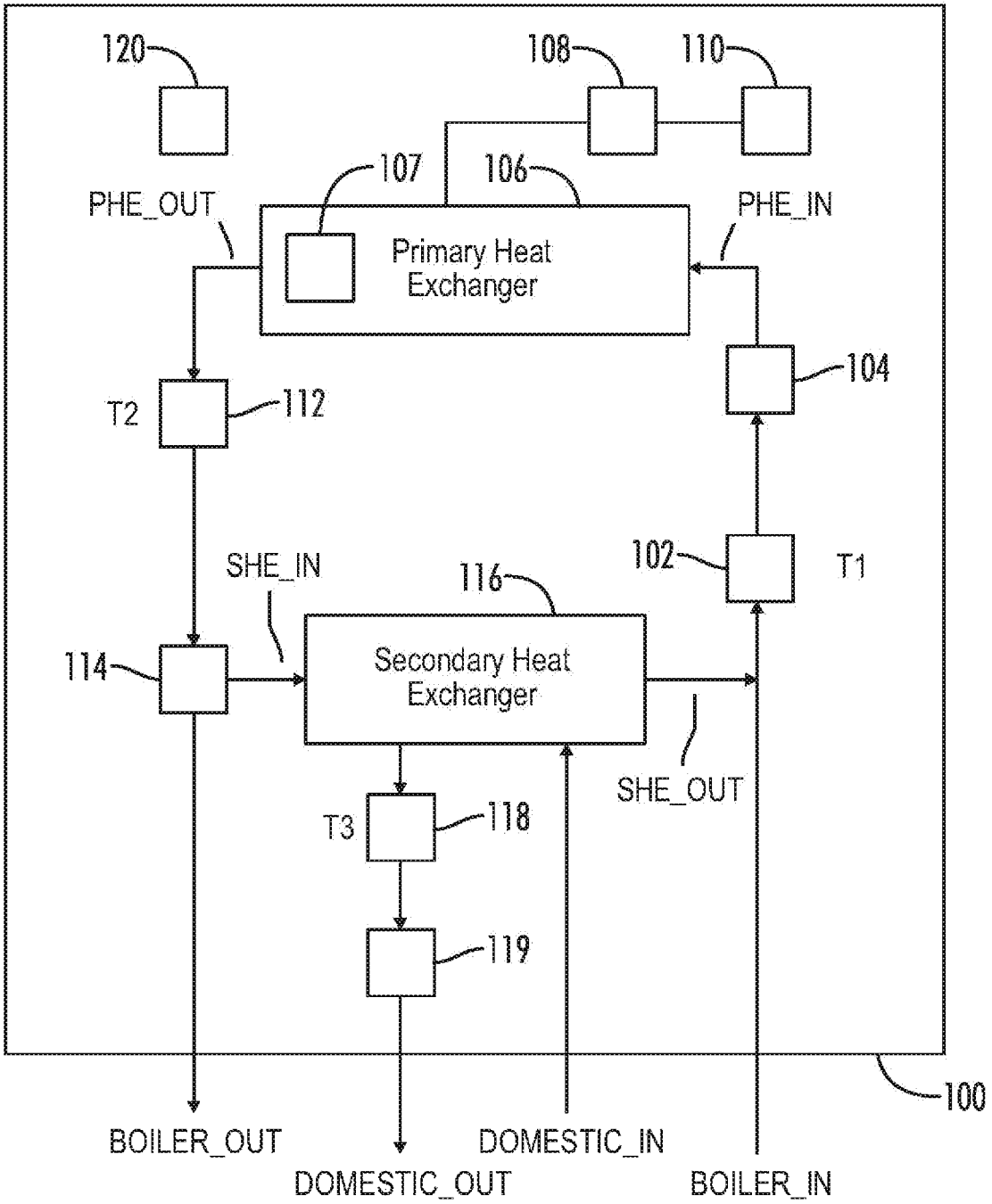
FIG. 1 is a graphical block diagram illustrating a combination boiler consistent with an exemplary embodiment.

Referring generally to FIGS. 1-18, various exemplary embodiments of an invention may now be described in detail. Where the various figures may describe embodiments sharing various common elements and features with other embodiments, similar elements and features are given the same reference numerals and redundant description thereof may be omitted below.

Various embodiments disclosed herein are directed to methods and systems for controlling a combination boiler. Exemplary implementations consistent with the present disclosure may reduce the time required to provide hot water at a desired water temperature by, for example, maintaining boiler loop water stored in a primary heat exchanger of a combination boiler at an elevated temperature in order to be able to start transferring heat immediately when a hot water demand is started but before the boiler can be fired. Implementations consistent with the present disclosure may also identify when a low flow condition associated with a DHW output occurs and operate an inlet pump of the combination boiler to initially satisfy the DHW demand using heat energy stored in boiler loop water at the primary heat exchanger, and then fire the combination boiler burner as needed to replenish stored heat energy. The present disclosure further provides advantages associated with providing hot water circulation/recirculation and providing thermal storage which may maximize cycle times and run times while still providing satisfactory operation. According to one aspect of the present disclosure, a DHW draw may be detected and one or more operations may be performed without the requirement of a DHW flow switch, and thus may resolve issues related to low flow DHW draws.

FIG. 1 illustrates a graphical block diagram illustrating a combination boiler consistent with an exemplary embodiment. The combination boiler 100 is configured to control operations associated with two water loops. The first loop is a boiler loop connected to the combination boiler 100 at an input BOILER_IN of the combination boiler 100 and an output BOILER_OUT of the combination boiler 100. In various embodiments the boiler loop may be configured to provide space heating or hydronic heating. The combination boiler 100 also includes a domestic water loop for providing potable water. The domestic loop connects to the combination boiler 100 at an input DOMESTIC_IN of the combination boiler 100 and is output from the combination boiler 100 at an output DOMESTIC_OUT. Although described as a loop, it should be appreciated that the domestic loop may take the form of either a closed or open flow loop. For example, the domestic loop may include one or more domestic water input sections configured to input domestic water into the domestic water loop.

In operation, the combination boiler 100 is configured to provide heat energy from the boiler loop to the domestic loop in order to provide heated domestic hot water (DHW) output. Boiler loop water is input to the combination boiler 100 at BOILER_IN and flows toward the primary heat exchanger (PHE) inlet temperature sensor 102. Although illustrated in FIG. 1 as being located within the combination boiler 100, it should be appreciated that the PHE inlet temperature sensor 102 may be physically located either internally or externally to the combination boiler 100, without departing from the spirit and scope of the present disclosure. A detected PHE inlet temperature T1 is measured by the PHE inlet temperature sensor 102. After passing the primary heat exchanger inlet temperature sensor 102, boiler loop water flows toward an inlet pump 104. In various embodiments, inlet pump 104 is configured to regulate a flow rate of boiler water in the boiler loop. The output of the inlet pump 104 (also illustrated with reference to PHE_IN in FIG. 1) continues to a primary heat exchanger 106.

Primary heat exchanger 106 may take the form of a shell and tube heat exchanger, a plate heat exchanger, a plate and shell heat exchanger, a fire-tube combustion heat exchanger, a water-tube combustion heat exchanger, an adiabatic wheel heat exchanger, a plate fin heat exchanger, a pillow plate heat exchanger, a fluid heat exchanger, a waste heat recovery heat exchanger, a dynamic scraped surface heat exchanger, a phase-change heat exchanger, a direct contact heat exchanger, a microchannel heat exchanger, or any other physical device capable of transferring heat energy to boiler loop water. Primary heat exchanger 106 may include a storage 107. The storage 107 is configured in one exemplary embodiment to store heated boiler loop water, the heated water having been heated by the burner 108. Although described and illustrated as a part of the primary heat exchanger 106, it should be appreciated that the storage 107 may be separate from the primary heat exchanger 106 and may be physically located either internally or externally to the combination boiler 100, without departing from the spirit and the scope of the present disclosure.

The primary heat exchanger 106 includes or is otherwise connected to a burner 108 or other heat source configured to provide heat. The burner 108 is configured to heat water contained within the boiler loop. The burner 108 may be configured to include an input fan 110. Although described with reference to a fan, it should be appreciated that the input fan 110 may be replaced by a water bypass configured to vary an amount of heat used to vary an amount of heated water passed through the secondary heat exchanger 116. In this exemplary embodiment, the bypass may be configured to be controlled (e.g., by the controller 120 rather than explicitly by the input fan 110). The input fan 110 is configured to supply a fuel and air mixture to the burner 108. Although the input fan 110 is described as part of the burner 108 in various embodiments, the input fan 110 may optionally be physically separate from the burner 108. Furthermore, at least one of the burner 108 and the input fan 110 may be physically located internally or externally (or a combination thereof) to the combination boiler 100. Although not illustrated in FIG. 1, the combination boiler 100 may include an energy input module configured to receive one or more sources of energy for use by the burner 108. For example, the combination boiler 100 may include a heating oil or natural gas input, where the heating oil or natural gas input is used by the burner 108 to provide heat energy to boiler loop water via the primary heat exchanger 106. Although described with reference to a burner, it should be appreciated that the burner 108 may take the form of one or more elements configured to provide heat energy to boiler loop water at the primary heat exchanger 106, and may or may not require the use of the input fan 110 during operation depending upon a particular implementation. In one or more exemplary embodiments, a burner 108 may take the form of one or more heating elements configured to regulate an amount of heat supplied to boiler loop water or domestic loop water.

Although described with respect to an input fan 110, it should be appreciated that one or more heat sources may be used to provide a heat input rate corresponding to the primary heat exchanger 106. In one exemplary embodiment, an input fan 100 may be configured to supply a volume of fuel and/or air, or a mixture thereof, to the burner 108 proportional to a given heat demand or input. In one or more exemplary embodiments, a fan speed as described herein may relate to a heat input associated with the primary heat exchanger 106. Alternatively or additionally, heat input corresponding to the burner 108 may be provided by one or more heating elements (e.g., an electric heating element) configured to be controlled by the controller 120. In one exemplary embodiment, the controller 120 may be configured to control one or more electric heating elements to provide a heat output characteristic to the one or more heating elements corresponding to a heating demand. Even further additionally or alternatively, the one or more heating elements are configured in one exemplary embodiment to supply an appropriate amount of fuel, air, heat, or other operational setting to the one or more heating elements (e.g., via one or more settings or pulses corresponding to an on/off heat source). An operational setting of the input fan 110 or one or more heating elements may be configured to correspond to an input heating demand and/or input. Optionally, a fan speed of the input fan 110 may be configured to correspond to a specific heat input.

Heated water is output from the primary heat exchanger 106 along output PHE_OUT. Heated water output from the primary exchanger 106 is received at PHE outlet temperature sensor 112. The PHE outlet temperature sensor 112 is configured in one embodiment to measure a PHE outlet temperature T2. Heated boiler loop water is received at the flow diverting valve 114 after passing the PHE temperature sensor 112. The flow diverting valve 114 is configured to provide a selected amount of heated water from the boiler loop to at least one of the boiler output BOILER_OUT and the secondary heat exchanger 116 (via input SHE_IN). In operation, the flow diverting valve 114 may be configured to direct all or a portion of heated boiler loop water from the primary heat exchanger 106 to the secondary heat exchanger 116. In various embodiments the flow diverting valve 114 may be configured to output all heated boiler loop water from the primary heat exchanger 106 via the BOILER_OUT output of combination boiler 100. In one exemplary embodiment, a flow path corresponding to the combination boiler 100 may be configured to bypass the BOILER_OUT and BOILER_IN of the combination boiler 100. In this exemplary embodiment, one or more additional temperature and/or flow sensors may be implemented in the combination boiler 100 (for example, one or more sensors may be provided corresponding to the SHE_OUT path). The additional one or more sensors may be implemented, for example, because a temperature at PHE inlet temperature sensor 102 might not match the SHE_OUT temperature (e.g., because of a potential status as a mixture of water, potentially at a different temperature measured relative to at least one of an inlet and an outlet of the secondary heat exchanger 116 rather than an inlet or an outlet of the primary heat exchanger 106).

Secondary heat exchanger 116 is configured to receive domestic input water (e.g., potable water) via input DOMESTIC_IN. The secondary heat exchanger 116 is configured to heat input domestic water by transferring heat energy received from the boiler loop to the domestic loop. Heated water output from the primary heat exchanger 106 is directed by the flow diverting valve 114 and through the secondary heat exchanger 116. In one exemplary embodiment, heated domestic hot water is output from the secondary heat exchanger 116. Although described with reference to a PHE outlet temperature, it should be appreciated that the PHE outlet temperature sensor 112 may be located at an input section of the secondary heat exchanger 116 and may, in one or more embodiments, correspond to an input temperature of the secondary heat exchanger 116 (for example, the PHE outlet temperature sensor 112 may be located at least one of before or after the flow diverting valve 114. A temperature of the domestic hot water output measured by a DHW output temperature sensor 118 in one exemplary embodiment. The DHW output temperature sensor 118 is configured to measure a domestic hot water temperature T3. After passing the DHW output temperature sensor 118, domestic loop heated water is output from the combination boiler 100 via the output DOMESTIC_OUT.

A controller 120 is configured to control operations of at least one component of the combination boiler 100. The controller 120 may be configured to include or otherwise access one or more memory storage elements to store or obtain at least one parameter used by the controller 120 to control at least a portion of operations performed by or corresponding to the combination boiler 100.

In one exemplary embodiment the controller 120 is configured to control operations of at least one of the flow diverting valve 114 and the inlet pump 104 to cause a predetermined amount of heated boiler loop water to be diverted from the boiler loop into the secondary heat exchanger 116 in order to transfer heat energy to domestic loop water. The controller 120 may be configured to provide domestic hot water output at a predetermined temperature (e.g., at a predetermined or user-specified set point temperature). Boiler loop water is output from the secondary heat exchanger 116 via the output SHE_OUT after transferring at least a portion of its heat energy to the domestic loop water. In one exemplary embodiment, boiler loop water output from the secondary heat exchanger 116 is received at the boiler loop at a position before the PHE inlet temperature sensor 102. Additionally or alternatively, at least a portion of the output boiler loop water from the secondary heat exchanger 116 may be received at any point of the boiler loop without departing from the spirit and the scope of the present disclosure.

The combination boiler 100 may include a flow switch 119 located at an output of the secondary heat exchanger 116. In one exemplary embodiment the flow switch 119 is located between the domestic hot water output temperature sensor 118 and the combination boiler DOMESTIC_OUT output of the combination boiler 100. The flow switch 119 may be configured to measure a DHW flow rate. In operation, the controller 120 may be configured to compare the DHW flow rate to a DHW demand flow rate threshold and control operations of the combination boiler 100 to (i) end a pre-heat operation, and (ii) fire the burner 108 when the DHW flow rate exceeds the DHW demand flow rate threshold.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable medium known in the art. An exemplary computer-readable medium can be coupled to the processor such that the processor can read information from, and write information to, the memory/storage medium. In the alternative, the medium can be integral to the processor.

Although described with reference to water loops, it should be appreciated that a combination boiler 100 in accordance with the present disclosure may be configured to heat one or more liquids via a primary fluid that may be directly or indirectly heated in a manner as described herein. For example, a combination boiler 100 may include a water heater providing a secondary space heating function using a secondary space heating function and a water heating element implementing two or more liquid sources for functionality. Alternatively or additionally, one or more exemplary embodiments may include a water heater without a space heating capability (e.g., as a system similar to that illustrated by FIG. 1, without requiring a BOILER_OUT and/or BOILER_IN connection, which may or may not include a different liquid to heat a loop liquid (e.g., as a heat pump water heater).

Figure 2:
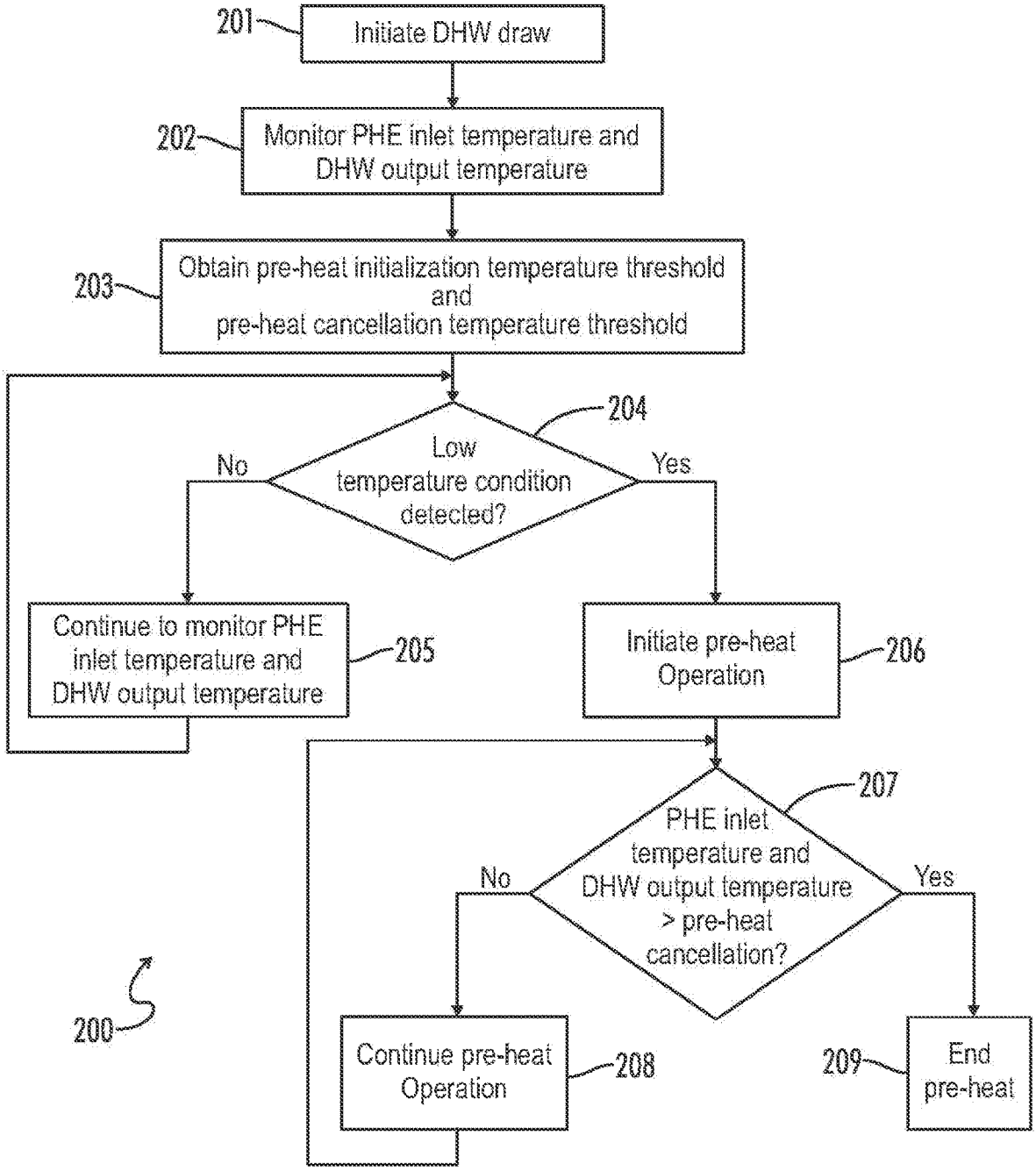
FIG. 2 illustrates an exemplary method for controlling pre-heat operation of a combination boiler.

FIG. 2 illustrates an exemplary method for controlling pre-heat operation of the combination boiler 100. The process 200 begins at a step 201 where a domestic hot water draw is initiated. In one exemplary embodiment, the domestic hot water draw corresponds to an output domestic hot water demand associated with the secondary heat exchanger 116. At a step 202 the PHE inlet temperature T1 and a DHW output temperature T3 are monitored. The pre-heat initialization temperature threshold (T_ON) and pre-heat cancellation temperature threshold (T_OFF) are obtained at a step 203. It is determined at a step 204 whether a low temperature condition is detected. In one exemplary embodiment, a low temperature condition corresponds to at least one of the PHE inlet temperature T1 or DHW output temperature T3 falling below the pre-heat initialization temperature threshold.

If a low temperature condition is not detected at the step 204 the process continues to a step 205 where the PHE inlet temperature T1 and DHW output temperature T3 are monitored, and the process returns to the step 204. If a low temperature condition is detected at the step 204 process continues to a step 206, where a pre-heat operation is initiated. It is determined at a step 207 whether both of the PHE inlet temperature T1 and the DHW output temperature T3 are greater than the pre-heat cancellation temperature threshold. If it is determined that both of the PHE inlet temperature T1 and the DHW output temperature T3 are not greater than the pre-heat cancellation temperature threshold, the process continues to a step 208, where a pre-heat operation is continued and the process returns to the step 207. If it is determined at the step 207 that both of the PHE inlet temperature T1 and the DHW output temperature T3 are greater than the pre-heat cancellation temperature threshold, the process continues to a step 209 where the pre-heat operation is ended.

Figure 3:
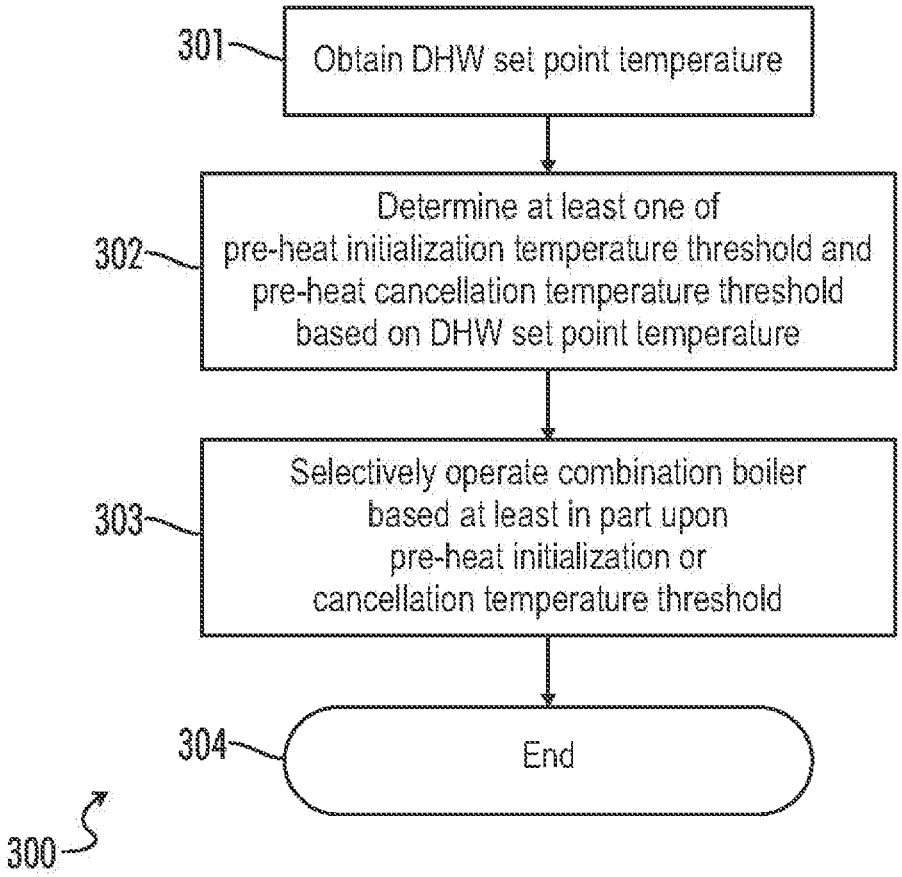
FIG. 3 illustrates an exemplary process for operating a combination boiler according to a DHW set point temperature.

FIG. 3 illustrates an exemplary process for operating a combination boiler according to a DHW set point temperature. The process 300 begins at a step 301, where a DHW set point temperature is obtained. The process continues to a step 302, where at least one of a pre-heat initialization temperature threshold (T_ON) and the pre-heat cancellation temperature threshold (T_OFF) are determined, based at least in part upon the DHW set point temperature. For example, at least one of the pre-heat initialization temperature and the pre-heat cancellation temperature threshold may increase or decrease with a respective increase or decrease in the DHW set point temperature (e.g., for a higher DHW set point temperature, the pre-heat initialization temperature threshold may be higher than that of a cooler DHW set point temperature in order for the combination boiler 100 to more quickly enter a pre-heat operation). At a step 303, the combination boiler 100 is selectively operated based at least in part upon at least one of pre-heat initialization and cancellation temperature thresholds in the manner described herein. The process ends at a step 304.

Figure 4:
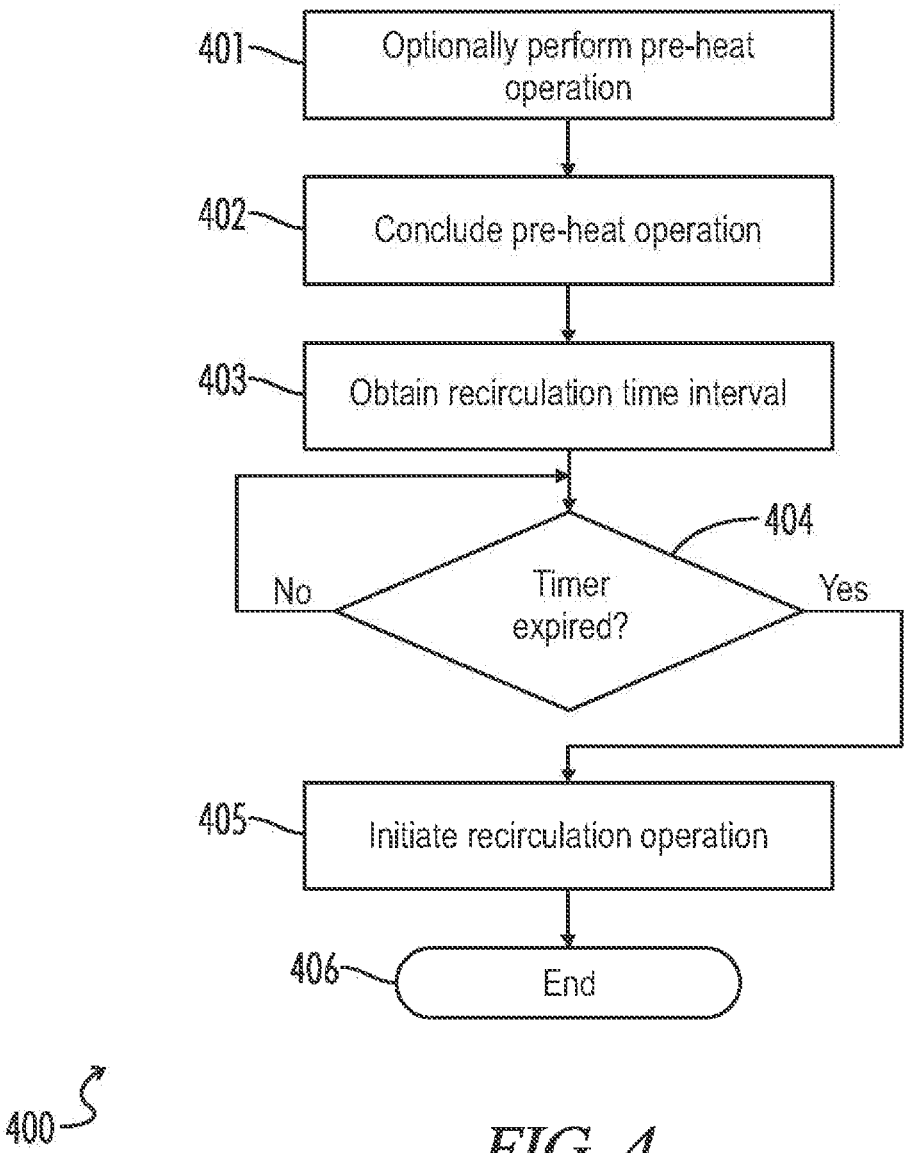
FIG. 4 illustrates an exemplary process for implementing a circulation time interval for a combination boiler.

FIG. 4 illustrates an exemplary process for implementing a circulation and/or recirculation time interval for a combination boiler. The process 400 begins at a step 401, where the combination boiler 100 initiates a pre-heat operation. The pre-heat operation concludes at step 402. After the pre-heat operation has concluded, the process continues to a step 403, where a circulation and/or recirculation (herein referred to as circulation) time interval is obtained. In one exemplary embodiment, the controller 120 is configured to monitor a period of time corresponding to the circulation time interval. The circulation time interval may include a periodic time period such as 30, 45, 60, or 90 minutes, or may be a non-periodic and/or demand-driven amount of time. After obtaining the circulation time interval, the process continues to a step 404, where it is determined whether a timer corresponding to the circulation time interval has expired. If the timer has not expired, the process returns to the step 404 until the timer has expired. If it is determined at the step 404 that the timer has expired, the process continues to a step 405, where a circulation operation is initiated.

In accordance with one exemplary embodiment of the present disclosure, a circulation operation may comprise periodically circulating water through at least the boiler loop of the combination boiler 100. Alternatively or additionally, a circulation operation may include circulating at least a portion of heated boiler loop water through the secondary heat exchanger 116 to transfer heat energy from the heated boiler loop water to domestic loop water via the secondary heat exchanger 116. The controller 120 may be configured to adjust or manipulate an operational setting of at least one of the inlet pump 104 and/or the flow diverting valve 114 to cause at least a portion of boiler loop water to pass through the secondary heat exchanger 116. After initiating the circulation operation at the step 405, the process concludes at a step 406. In one exemplary embodiment, the circulation operation described with reference to FIG. 4 may be used to monitor a stored water temperature of boiler loop water, for example stored by storage 107. The circulation operation may be performed either with or without concurrent water flow in the domestic water loop in various embodiments.

Figure 5:
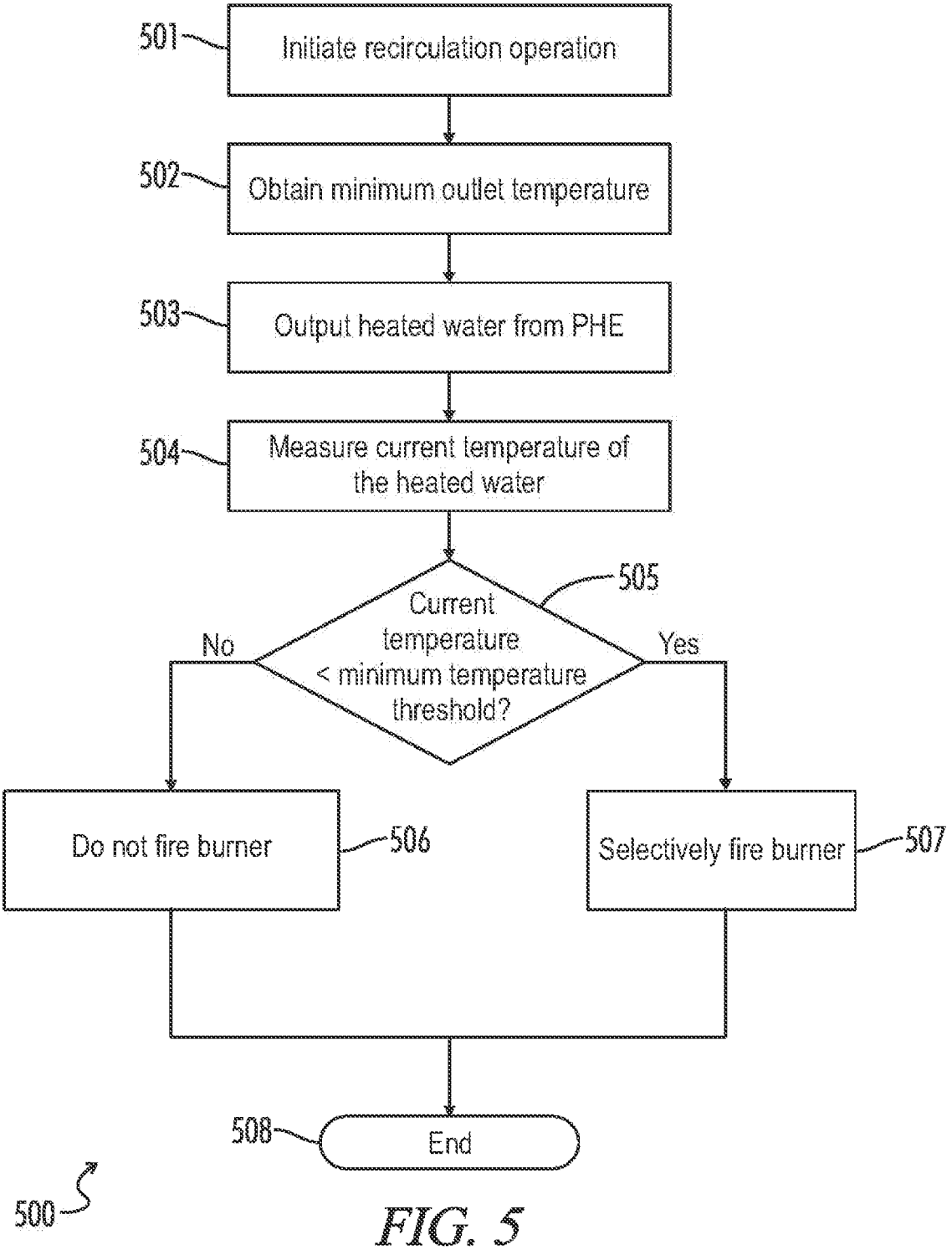
FIG. 5 illustrates a circulation process in accordance with an exemplary embodiment.

FIG. 5 illustrates an exemplary circulation operation in accordance with aspects of the present disclosure. The process 500 begins at a step 501, where a circulation operation is initiated. Either before or after initiating the circulation operation at the step 501, a minimum outlet temperature threshold (also described herein with reference to T_FIRE) is obtained at a step 502. The process continues to a step 503, where heated boiler loop water is output from the primary heat exchanger 106. The heated boiler loop water output by the primary heat exchanger 106 may, in one exemplary embodiment, take the form of water stored at the storage 107. At a step 504, a current temperature of the heated boiler loop water output from the primary heat exchanger 106 is measured. The current temperature of the heated boiler loop water may be measured by the PHE outlet temperature sensor 112 in one embodiment. It is determined at a step 505 whether the current temperature of the heated water is less than the minimum outlet temperature threshold. If the current temperature is not less than the minimum outlet temperature threshold, the process continues to a step 506, where the burner 108 is not fired and the process ends at a step 508. If it is determined at the step 505 that the current temperature is less than the minimum outlet temperature threshold, the process continues to a step 507 where the burner 108 is selectively fired and the process then concludes at the step 508.

Figure 6:
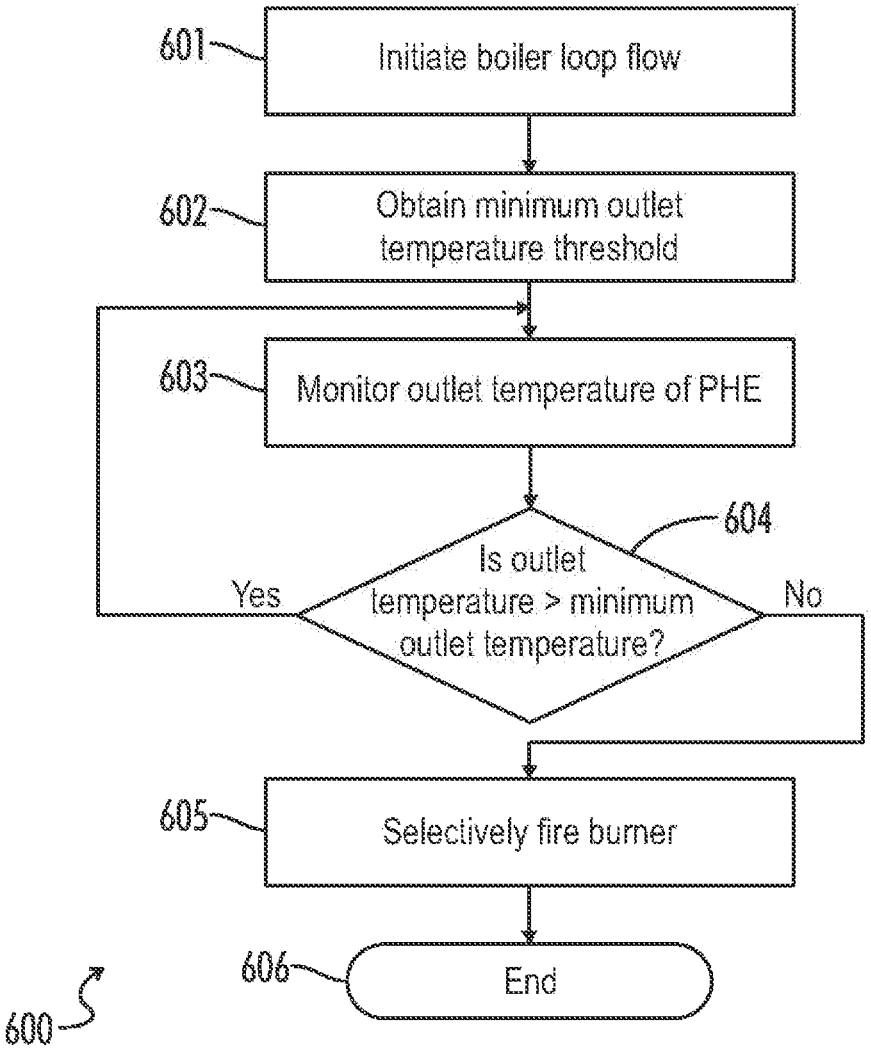
FIG. 6 illustrates an exemplary process for controlling burner firing for a combination boiler.

FIG. 6 illustrates an exemplary process for controlling burner firing for a combination boiler. The process 600 begins at step 601, where a boiler loop flow is initiated. A minimum outlet temperature threshold (T_FIRE) is obtained at a step 602. At a step 603, an outlet temperature (T2) of the primary heat exchanger 106 is monitored (for example, by the PHE outlet temperature sensor 112). It is determined a step 604 whether the PHE outlet temperature T2 is greater than the minimum outlet temperature threshold. If it is determined at the step 604 that the PHE outlet temperature T2 is greater than the minimum outlet temperature threshold, the process returns to step 603, where the PHE outlet temperature T2 is monitored. If it is determined at the step 604 that the outlet PHE temperature T2 is not greater the minimum outlet temperature threshold, the process continues to a step 605, where the burner 108 is selectively fired. The process then concludes at the step 606.

Figure 7:
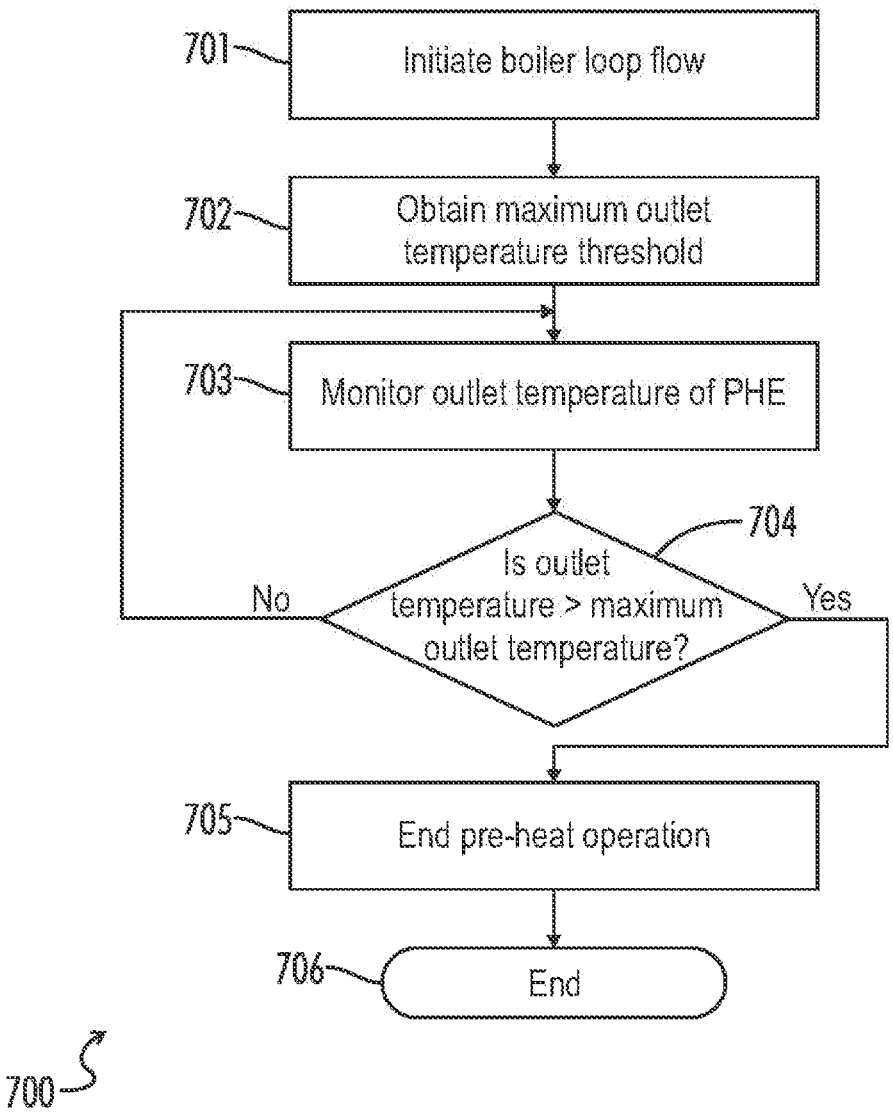
FIG. 7 illustrates an exemplary process for selectively ending pre-heat operations of a combination boiler.

FIG. 7 illustrates an exemplary process for selectively ending a pre-heat operation of a combination boiler. The process 700 begins at a step 701, where a boiler loop flow is initiated. Either before or after initiating the boiler loop flow at the step 701, a maximum outlet temperature threshold (also described herein with reference to TEND) is obtained at step 702. At a step 703, an outlet temperature (T2) of the primary heat exchanger 106 is monitored (for example, by the PHE outlet temperature sensor 112). It is determined at a step 704 whether the PHE outlet temperature T2 is greater than the maximum outlet temperature threshold. If it is determined that the PHE outlet temperature T2 is not greater than the maximum outlet temperature threshold, the process returns to the step 703, where the PHE outlet temperature T2 continues to be monitored. If it is determined at the step 704 that the PHE outlet temperature T2 is greater than the maximum outlet temperature threshold, the process continues at a step 705, where a pre-heat operation is ended and the controller 120 causes the burner 108 to stop firing. The process then concludes at the step 706.

Figure 8:
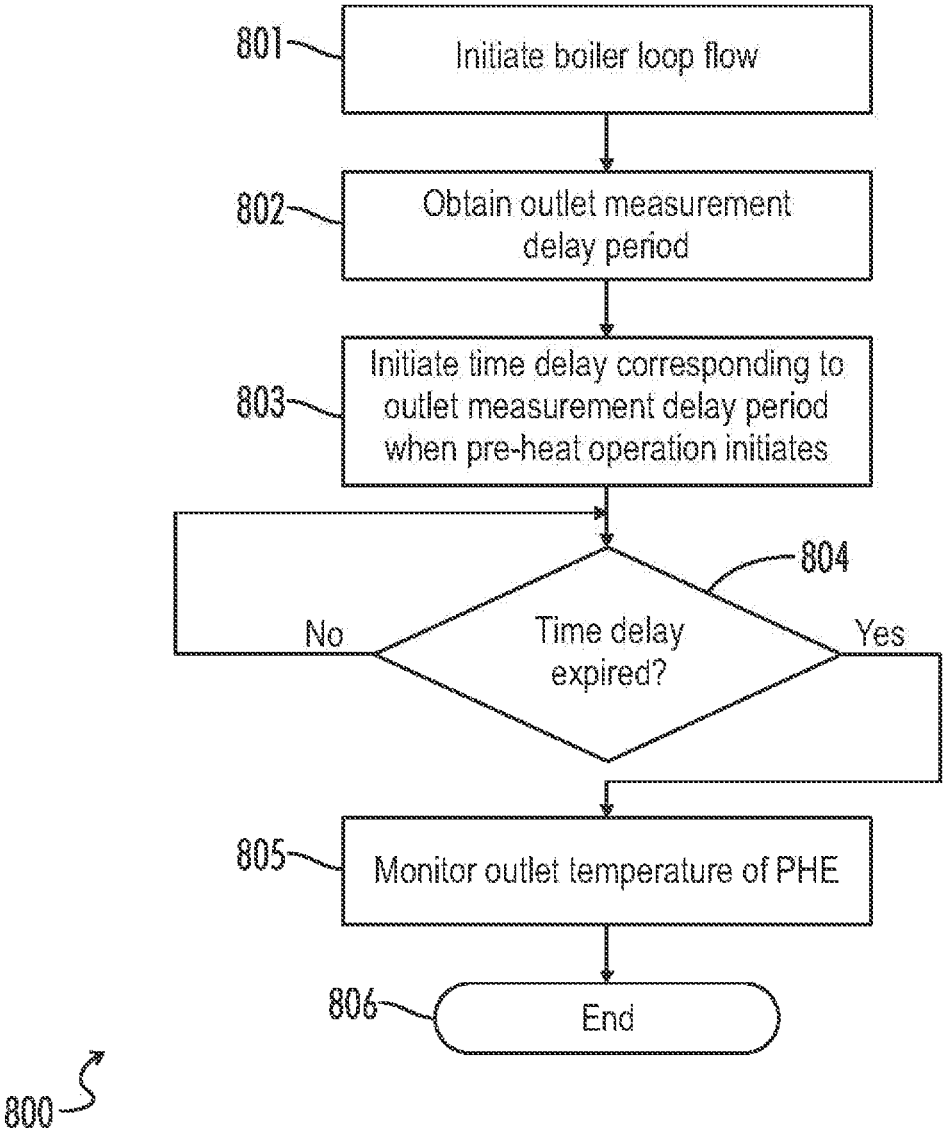
FIG. 8 illustrates an exemplary process for providing delayed measurement corresponding to a pre-heat operation of a combination boiler.

FIG. 8 illustrates an exemplary process for providing delayed measurement corresponding to a pre-heat operation of a combination boiler. The process 800 begins at a step 801, where a boiler loop flow is initiated. Either before or after initiating the boiler loop flow at the step 801, an outlet measurement delay period is obtained at a step 802. At a step 803, a time delay corresponding to the outlet measurement delay period is initiated when a pre-heat operation begins. The controller 120 may execute a delay time period corresponding to the outlet measurement delay period. It is determined at a step 804 whether the time delay has expired. If it is determined at the step 804 that the time delay has not expired, the process returns to the step 804 until the time delay has expired. If it is determined at a step 804 that the time delay has expired, the process continues to a step 805, where an outlet temperature (T2) of the primary heat exchanger 106 is monitored. The process then concludes at a step 806. In one exemplary embodiment, the time delay corresponding to the outlet measurement delay period is implemented to allow sufficient flow through the boiler loop of the combination boiler 100 to permit an accurate temperature reading of boiler loop water. In various embodiments, a temperature of heated boiler loop water stored at the storage 107 may be measured by the PHE outlet temperature sensor 112.

Figure 9:
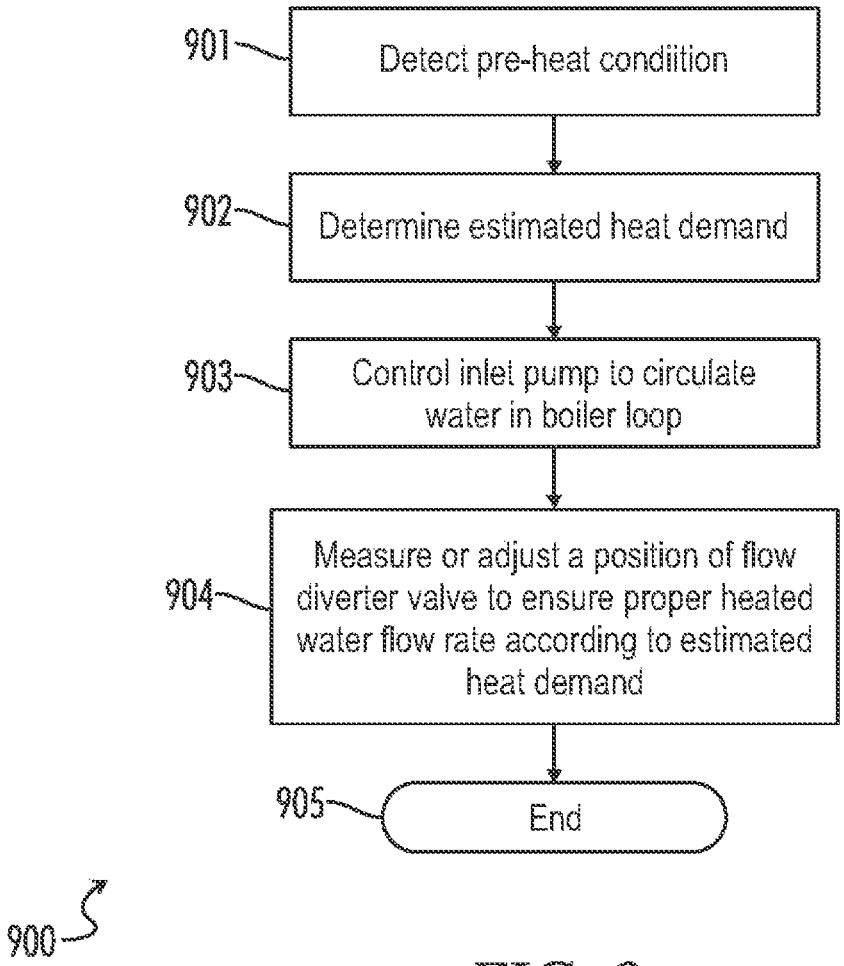
FIG. 9 illustrates an exemplary control process for diverting at least a portion of boiler loop water by the combination boiler.

FIG. 9 illustrates an exemplary control process for diverting at least a portion of boiler loop water by the combination boiler. The process 900 begins at a step 901, where a pre-heat condition is detected. As previously described, a pre-heat condition may include a low temperature condition associated with at least one of the PHE inlet temperature T1 or DHW output temperature T3, relative to the pre-heat initialization temperature threshold T_ON. After the pre-heat condition is detected at the step 901, the process continues to a step 902, where an estimated heat demand is determined. After determining an estimated heat demand, the controller 120 is configured, in one exemplary embodiment, to cause the inlet pump 104 to circulate water in the boiler loop at a step 903. The process continues to a step 904, where a position of the flow diverter valve 114 is either measured or adjusted to ensure a proper heated water flow rate according to the estimated heat demand. The process then concludes at a step 905.

Figure 10:
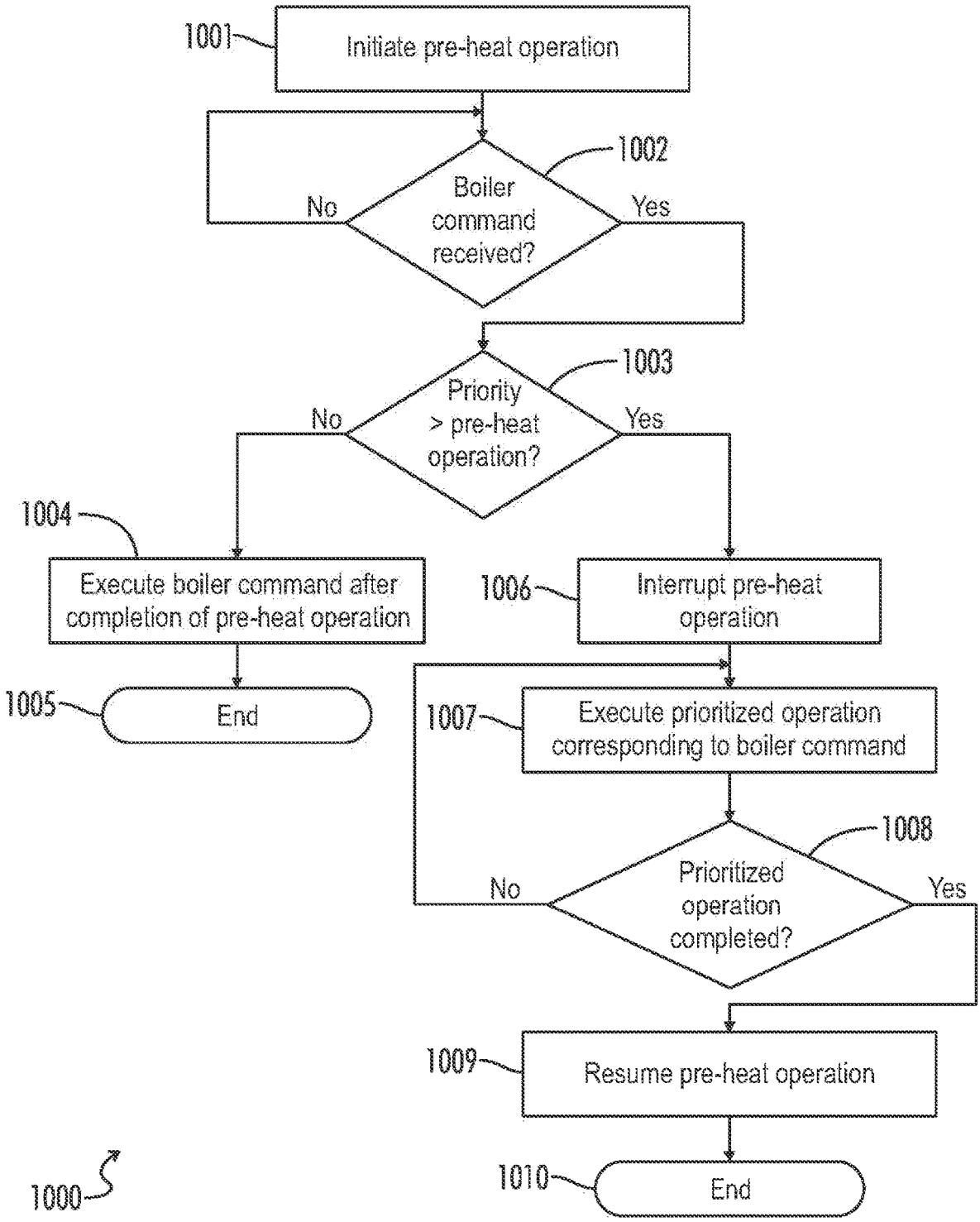
FIG. 10 illustrates an exemplary process for executing a prioritized operation during execution of a pre-heat operation.

FIG. 10 illustrates an exemplary process for providing a prioritized operation during execution of a pre-heat operation. The process 1000 begins at a step 1001, where a pre-heat operation is initiated. After initiating the pre-heat operation, the process continues to a step 1002, where it is determined whether a boiler command has been received. If it is determined at the step 1002 that a boiler command has not been received, the process returns to the step 1002 until a boiler command is received. If it is determined that the step 1002 that a boiler command has been received, the process continues to a step 1003, where it is determined whether a priority associated with the received boiler command is greater than that of the current pre-heat operation. If the priority of the received boiler command is less than the current pre-heat operation, the process continues to a step 1004, where at least one operation corresponding to the received boiler command is executed after completion of the pre-heat operation. The process then ends at step 1005.

If it is determined at the step 1003 that the priority of the received boiler command is greater than the current pre-heat operation, the process continues to a step 1006, where the current pre-heat operation is interrupted. After the current pre-heat operation is interrupted at the step 1006, the process continues to a step 1007, where at least one prioritized operation corresponding to the received boiler command is executed. It is determined at a step 1008 whether the prioritized operation has completed. If it is determined at the step 1008 that the prioritized operation is not completed, the process returns to the step 1007, where at least one operation corresponding to the boiler command is executed. If it is determined at the step 1008 that the prioritized operation has completed, the process continues to a step 1009, where the interrupted pre-heat operation is resumed. The process then concludes at a step 1010.

Figure 11:
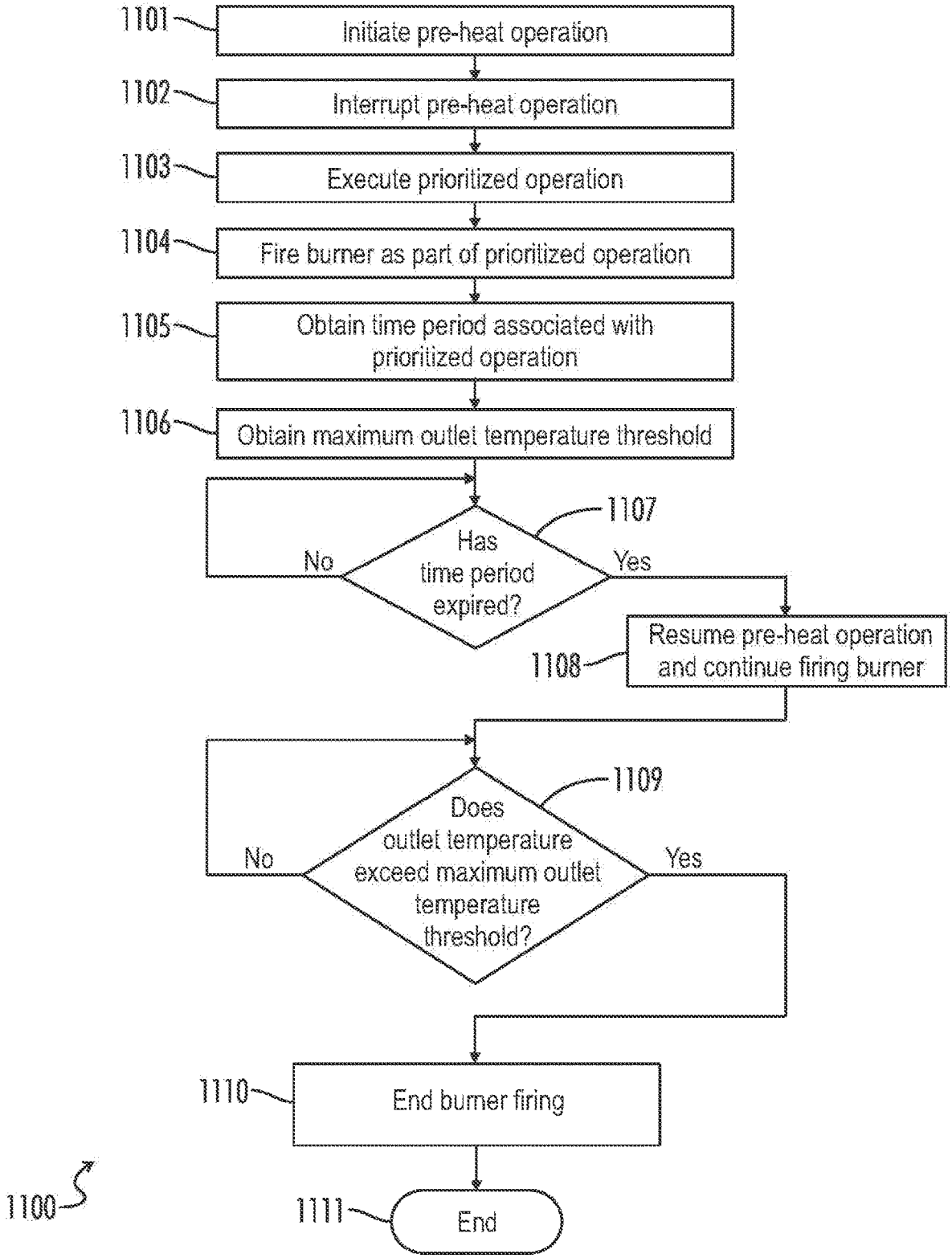
FIG. 11 illustrates an exemplary process for controlling burner firing when a prioritized operation is received.

FIG. 11 illustrates an exemplary process for controlling burner firing when a prioritized operation is received. The process 1100 begins at a step 1101, where a pre-heat operation is initiated. At a step 1102, the pre-heat operation is interrupted. At least one prioritized operation corresponding to the received interrupt is executed at a step 1103. At a step 1104, the burner 108 is fired as part of a prioritized operation. A time period associated with the prioritized operation is obtained at a step 1105. A maximum outlet temperature threshold (e.g., maximum outlet temperature threshold TEND) is obtained at a step 1106. It is determined at a step 1107 whether the time period associated with the prioritized operation has expired. If it is determined at the step 1107 that the time period has not expired, the process continues to wait until the time period has expired. If it is determined at the step 1107 that the time period has expired, the process continues to a step 1108, where the interrupted pre-heat operation is resumed and the burner 108 continues to fire. The process then continues to step 1109, where it is determined whether the outlet temperature (T2) of the primary heat exchanger 106 exceeds the maximum outlet temperature threshold. In one exemplary embodiment, the PHE outlet temperature T2 is measured by the PHE outlet temperature sensor 112. If it is determined that the PHE outlet temperature T2 does not exceed the maximum outlet temperature threshold, the process returns to the step 1109 until the PHE outlet temperature T2 exceeds the maximum outlet temperature threshold. If it is determined at the step 1109 that the PHE outlet temperature T2 exceeds the maximum outlet temperature threshold, the process continues to a step 1110, where firing the burner 108 is ended and the process concludes at a step 1111.

Although illustrated in FIG. 11 as being performed sequentially, the determinations made at the steps 1107 and 1109 may be determined concurrently or in a non-cascaded fashion. For example, in one exemplary embodiment, the burner 108 may continue to fire after resuming the pre-heat operation until at least one of (i) the time period expires or (ii) the outlet temperature exceeds the maximum outlet temperature threshold.

Figure 12:
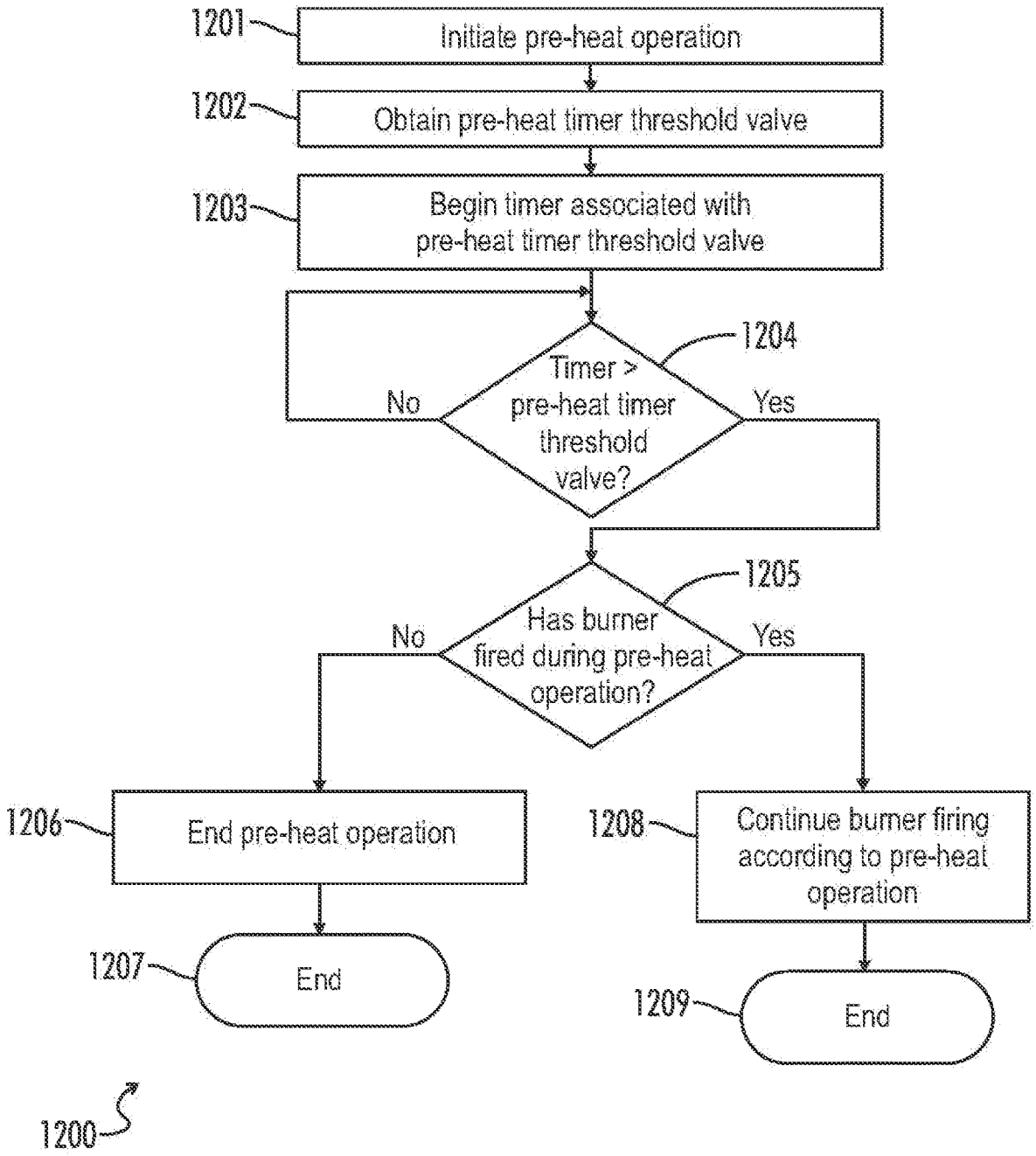
FIG. 12 illustrates an exemplary control method for providing a pre-heat timer threshold value corresponding to a pre-heat operation.

FIG. 12 illustrates an exemplary control method for providing a pre-heat timer threshold value corresponding to a pre-heat operation. The process 1200 begins at a step 1201, where a pre-heat operation is initiated. A pre-heat timer threshold value is obtained at a step 1202. After the pre-heat timer threshold value is obtained, a timer associated with the pre-heat timer threshold value is initiated at a step 1203. The timer may be configured to increase in value over time, and a current timer value may be compared to the pre-heat timer threshold value. It is determined at a step 1204 whether the current timer value is greater than the pre-heat timer threshold value. If it is determined that the step 1204 that the timer value is not greater than the pre-heat timer threshold value, the process returns to the step 1204 until the timer value is greater than the pre-heat timer threshold value. If it is determined at the step 1204 that the timer value is greater than the pre-heat timer threshold value, the process continues to a step 1205, where it is determined whether the burner has fired during a current pre-heat operation. If it is determined at the step 1205 that the burner has not fired during the current pre-heat operation, the process continues to a step 1206, where the pre-heat operation is ended and the process concludes at a step 1207. If it is determined at a step 1205 that the burner has fired during a current pre-heat operation, the process continues to a step 1208, where burner 108 continues to fire according to the current pre-heat operation. The process then concludes at a step 1209.

Figure 13:
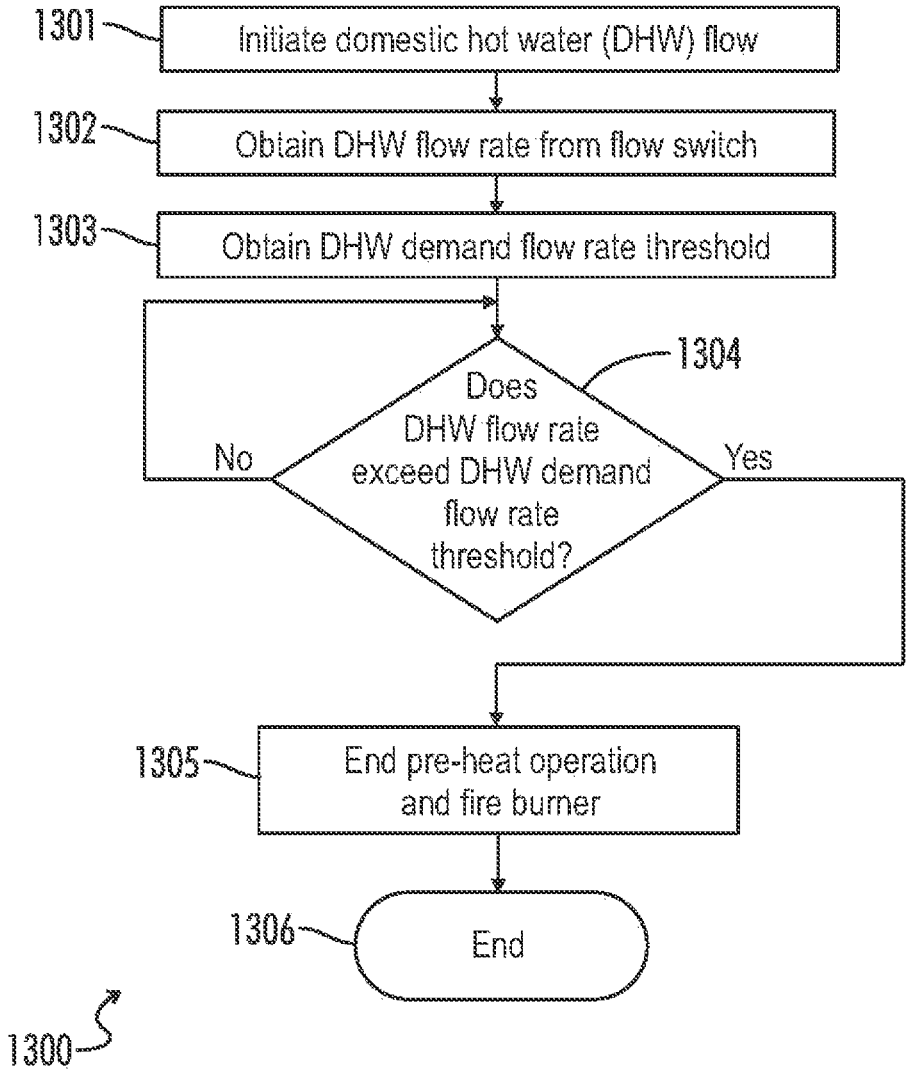
FIG. 13 illustrates an exemplary process for providing flow-based control for a combination boiler.

FIG. 13 illustrates an exemplary process for providing flow-based control for a combination boiler. The process 1300 begins at a step 1301, where a DHW flow is initiated.

The DHW flow rate is obtained from a flow switch (e.g., flow switch 119) at a step 1302. Additionally or alternatively, the DHW flow rate may be estimated based, at least in part, upon at least one of a DHW output temperature, a DHW input temperature, and an inlet temperature of the primary heat exchanger 106. A DHW demand flow rate threshold is obtained at a step 1303. It is determined at a step 1304 whether the DHW flow rate exceeds the DHW demand flow rate threshold. If it is determined at the step 1304 that the DHW flow rate does not exceed the DHW demand flow rate threshold, the process waits until the DHW flow rate exceeds the DHW demand flow rate threshold. If it is determined at step 1304 that the DHW flow rate exceeds the DHW demand flow rate threshold, the process continues to at step 1305, where the pre-heat operation is ended and the burner 108 is fired. The process then concludes at a step 1306.

Figure 14:
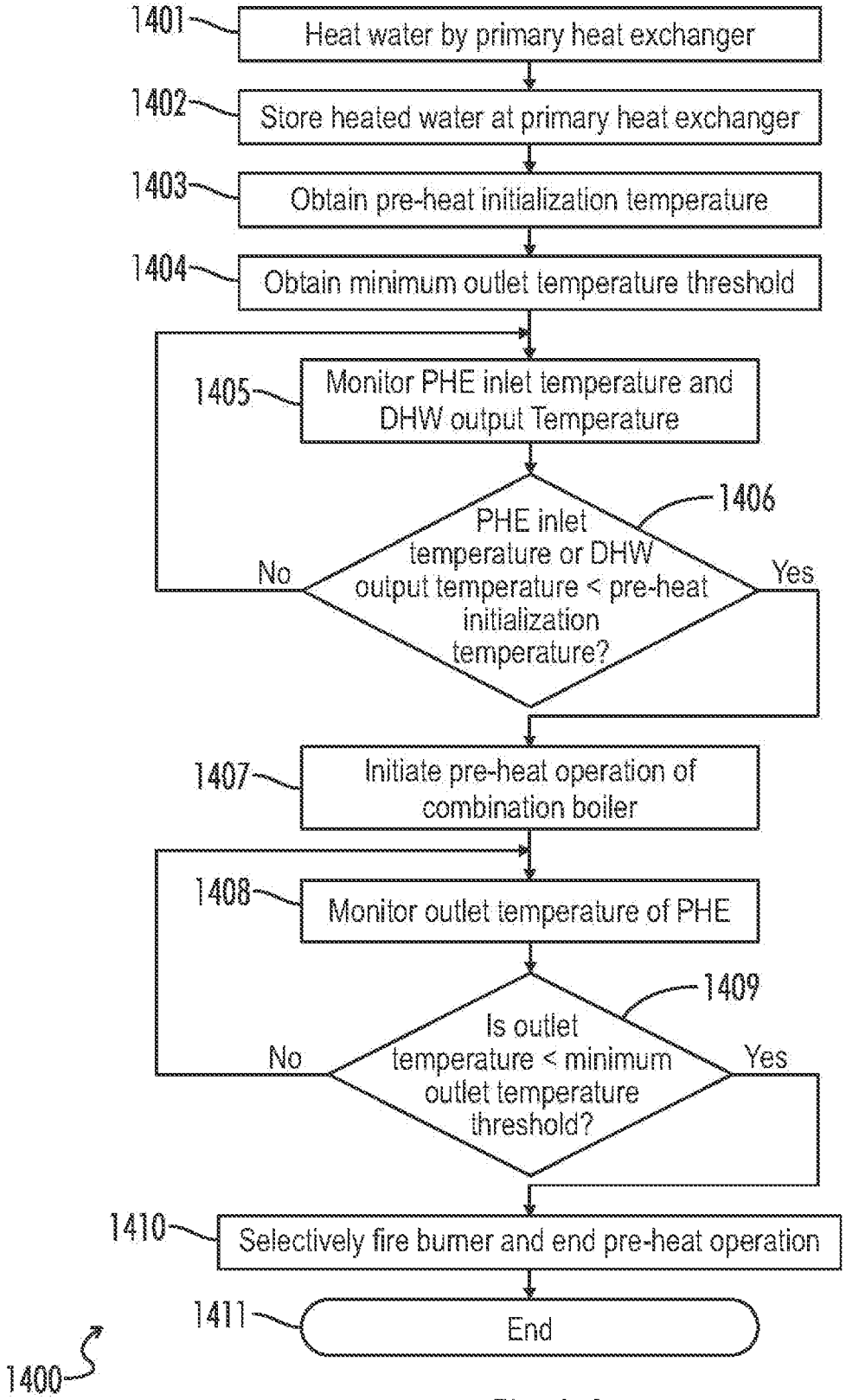
FIG. 14 illustrates an exemplary process for providing combination boiler control and burner firing.

FIG. 14 illustrates an exemplary process for providing combination boiler control and burner firing. The process 1400 begins at a step 1401, where boiler loop water is heated by the primary heat exchanger 106. The process continues to a step 1402, where heated water heated by the primary heat exchanger 106 is stored at the primary heat exchanger 106. In one exemplary embodiment, at least a portion of the heated boiler loop water is stored at the storage 107. The process continues to a step 1403 where a pre-heat initialization temperature threshold (also described herein with reference to T_ON) is obtained. At a step 1404, a minimum outlet temperature threshold (also described herein with reference T_FIRE) is obtained.

The PHE inlet temperature T1 and a DHW output temperature T3 are monitored at a step 1405. It is determined at a step 1406 whether the PHE inlet temperature T1 or the DHW output temperature T3 is less than the pre-heat initialization temperature threshold. If it is determined at the step 1406 that at least one of the PHE inlet temperature T1 or the DHW output temperature T3 is greater than the pre-heat initialization temperature threshold, the process returns to the step 1405, where the PHE inlet temperature T1 and the DHW output temperature T3 continue to be monitored. If it is determined at the step 1406 that at least one of the PHE inlet temperature T1 or the DHW output temperature T3 is less than the pre-heat initialization temperature threshold, the process continues to a step 1407, where a pre-heat operation of the combination boiler 100 is initiated. The process then continues to a step 1408, where an outlet temperature of the primary heat exchanger 106 is monitored (i.e., PHE outlet temperature T2). It is determined at a step 1409 whether the PHE outlet temperature T2 is less than the minimum outlet temperature threshold at a step 1409. If it is determined at the step 1409 that the PHE outlet temperature T2 is not less than the minimum outlet temperature threshold, the process returns to the step 1408 where the outlet temperature of the primary heat exchanger is monitored. If it is determined at the step 1409 that the PHE outlet temperature T2 is less than the minimum outlet temperature threshold, the process continues to a step 1410, where the burner 108 is selectively fired and the pre-heat operation is ended. The process concludes at a step 1411.

Figure 15:
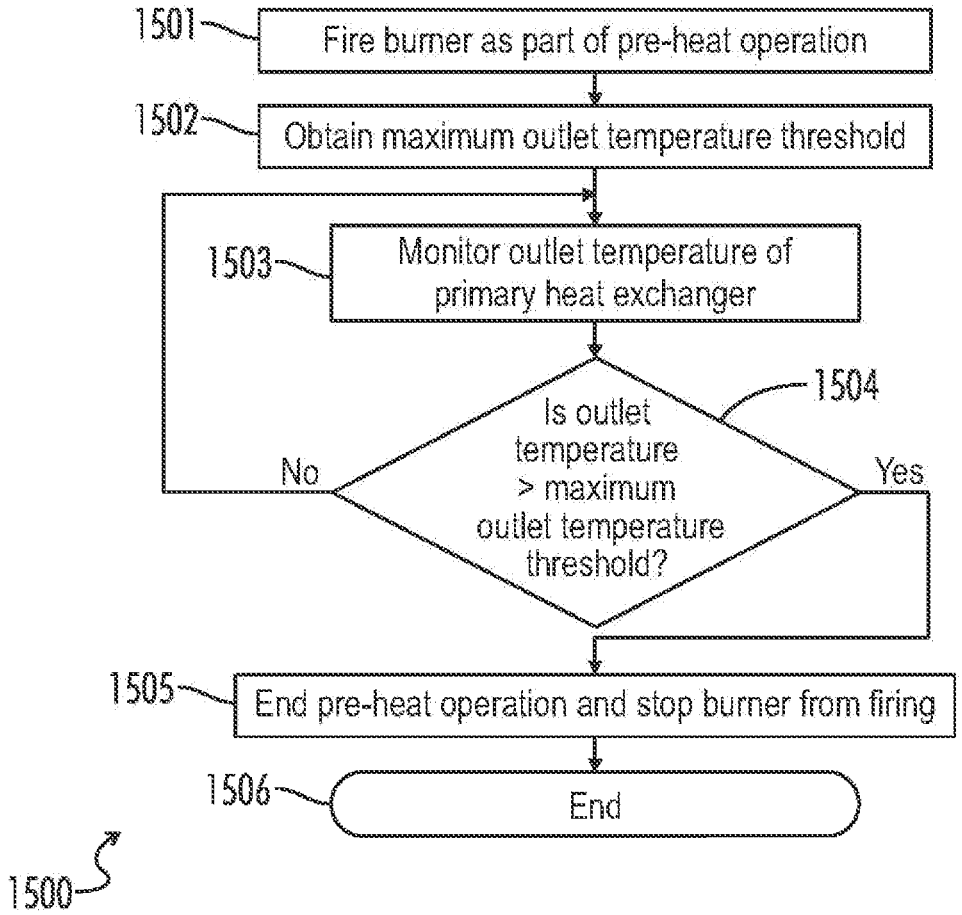
FIG. 15 illustrates an exemplary burner firing control process for a combination boiler.

FIG. 15 illustrates an exemplary burner firing control process for a combination boiler. The process 1500 begins at a step 1501, where the burner 108 of the combination boiler 100 is fired as part of a pre-heat operation. A maximum outlet temperature threshold (also described herein with reference to TEND) is obtained at a step 1502. An outlet temperature (T2) of the primary heat exchanger 106 is monitored at a step 1503. In one exemplary embodiment, the PHE outlet temperature T2 may be measured by the PHE outlet temperature sensor 112. It is determined at a step 1504 whether the PHE outlet temperature T2 is greater than the maximum outlet temperature threshold. If it is determined at a step 1504 that the PHE outlet temperature T2 is not greater than the maximum outlet temperature threshold, the process returns to the step 1503, where the PHE outlet temperature T2 continues to be monitored. If it is determined at the step 1504 that is PHE outlet temperature T2 is greater than the maximum outlet temperature threshold, the process continues to a step 1505, where the pre-heat operation is ended and the burner is stopped from firing. The process then concludes at a step 1506.

Figure 16:
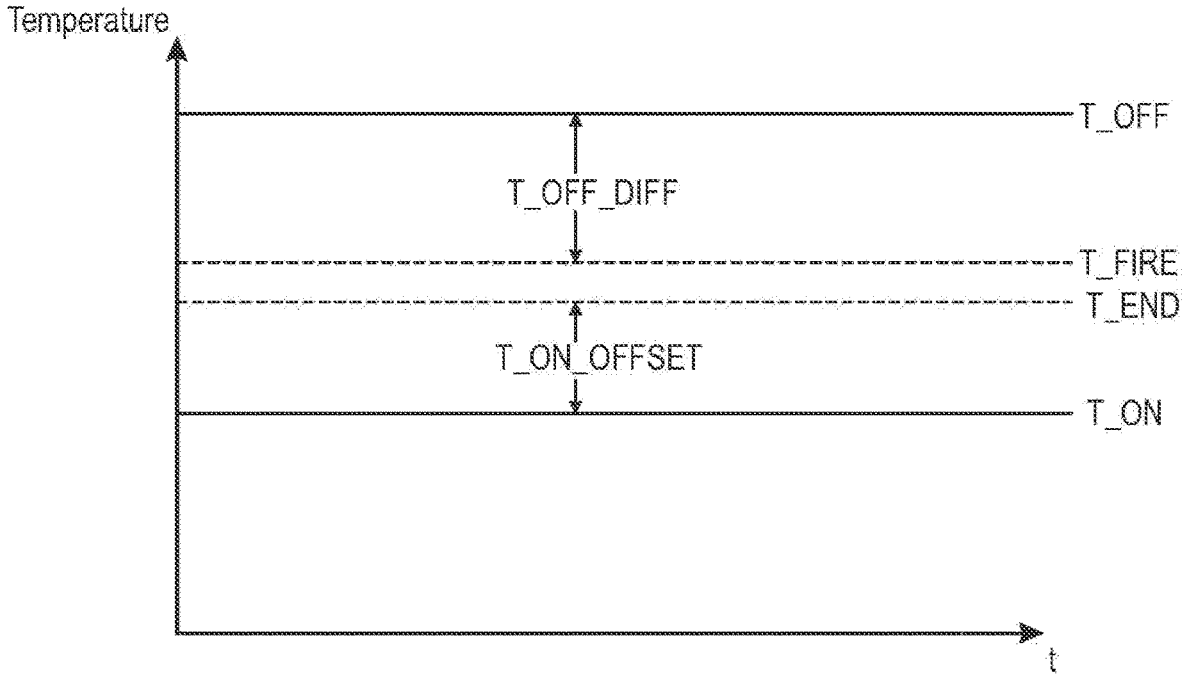
FIG. 16 illustrates a chart reflecting relationships between temperature thresholds used in providing combination boiler control.

FIG. 16 illustrates an a chart reflecting the relationship between temperature thresholds used in providing combination boiler control. The X-axis of chart 1600 represents a time value and the Y-axis of the chart represents a temperature value. T_OFF represents the pre-heat cancellation temperature threshold corresponding to an outlet temperature of the primary heat exchanger 106 (e.g., PHE outlet temperature T2). T_FIRE represents a minimum outlet temperature threshold related to an outlet temperature of the primary heat exchanger 106 (e.g., PHE outlet temperature T2). T_OFF_DIFF represents an offset between the values of T_OFF and T_FIRE, and further represents an operational temperature range with respect to an output of the primary heat exchanger 106 to allow operations of the combination boiler 100 without firing the burner 108 of the combination boiler 100. T_END represents a maximum outlet temperature threshold of DHW output (e.g., DHW output temperature T3) and an inlet temperature of the primary heat exchanger 106 (e.g., PHE inlet temperature T1). T_ON represents a pre-heat initialization temperature threshold corresponding to DHW output (e.g., DHW output temperature T3) from the secondary heat exchanger 116 and the inlet temperature of the primary heat exchanger 106 (e.g., PHE inlet temperature T1). T_ON_OFFSET represents an offset between the values of T_END and T_ON corresponding to an operational temperature range of values of both the DHW output temperature T3 and the PHE inlet temperature T3, within which a pre-heat operation of the combination boiler 100 is not specifically initiated or ended.

Although illustrated in a linear and constant manner, it should be appreciated by one having ordinary skill in the art that each of the values corresponding to T_OFF, T_OFF_DIFF, T_FIRE, T_END, T_ON_OFFSET and T_ON, may take the form of non-constant values and may fluctuate during operation.

Figure 17:
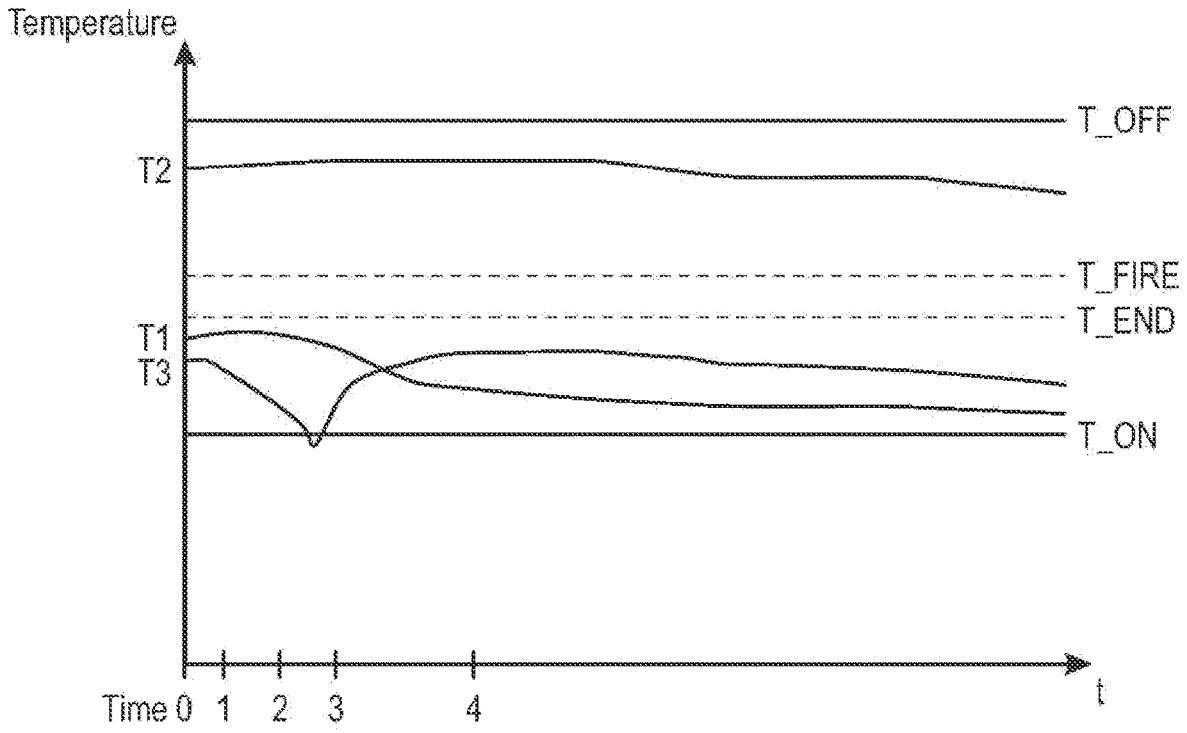
FIG. 17 illustrates an exemplary timing diagram for an implementation where a burner of a combination boiler does not fire during a pre-heat operation.

FIG. 17 illustrates an exemplary timing diagram in accordance with aspects of the present disclosure. Specifically, FIG. 17 illustrates a timing diagram for an implementation where a DHW output temperature drops below the pre-heat initialization temperature threshold, causing a pre-heat operation of the combination boiler 100 to be performed. In the implementation of FIG. 17, heated water stored at the primary heat exchanger 106 is sufficient, when circulated through the secondary heat exchanger 116, to cause the DHW output temperature demand to be satisfied without causing the burner 108 of the combination boiler 100 to fire.

As illustrated in FIG. 17, both of the PHE inlet temperature T1 and the DHW output temperature T3 of the combination boiler 100 are within the range of the pre-heat initialization temperature threshold T_ON and the maximum outlet temperature threshold T_END at time0. At time1 of FIG. 17, a DHW draw begins and the DHW output temperature T3 begins to decrease based, at least in part, upon a DHW input water temperature of the domestic loop.

At time2 of FIG. 17, the DHW output temperature T3 drops below the pre-heat initialization temperature threshold T_ON and causes a pre-heat operation to be initiated at the combination boiler 100. Because the PHE outlet temperature T2 is greater than the minimum outlet temperature threshold T_FIRE at time2, the controller 120 causes boiler loop water to be flowed from the primary heat exchanger 106 through the secondary heat exchanger 116 via at least one of the inlet pump 104 and flow diverting valve 114. Heat energy transferred from the heated boiler loop water to water in the domestic loop at the secondary heat exchanger 116 causes the DHW output temperature T3 to increase and become greater than the pre-heat initialization temperature threshold T_ON.

In one exemplary embodiment, the DHW output temperature T3 may correspond to a predetermined or user specified set point temperature. In the embodiment illustrated by FIG. 17, at time3, the DHW output temperature T3 corresponds to the set point temperature. When the DHW output temperature T3 reaches the set point temperature, the controller 120 of the combination boiler 100 may be configured to modify a rate of boiler loop water flow from the boiler loop through the secondary heat exchanger 116. For example, an amount of boiler loop water diverted from the boiler loop through the secondary heat exchanger 116 by the flow diverting valve 114 and/or inlet pump 104 may be slowed or stopped when the DHW output temperature T3 reaches or approaches the set point temperature.

In the embodiment illustrated by FIG. 17, sufficient water is stored at the storage 107 of the primary heat exchanger 106, such that when a pre-heat operation begins and heated boiler loop water is circulated from the boiler loop through the secondary heat exchanger 116, the heat demand associated with a DHW draw is satisfied by the energy transfer from the circulated heated water from the storage 107. At time4 of FIG. 17, the DHW draw is ended and each of the PHE inlet temperature T1, the PHE outlet temperature T2, and the DHW output temperature T3 slowly decrease over time, for example towards an ambient temperature. In this example, the pre-heat operation may end, for example, by the expiration of a pre-heat operation timer.

Figure 18:
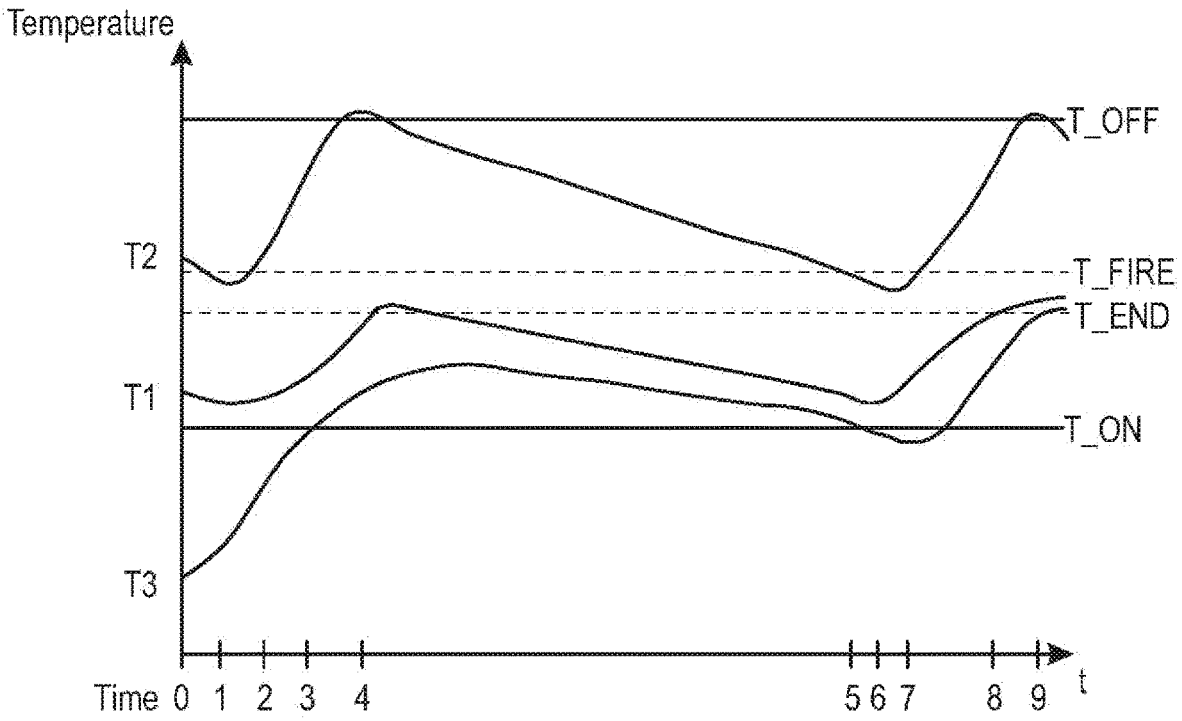
FIG. 18 illustrates an exemplary timing diagram for an implementation where a burner of a combination boiler is fired.

FIG. 18 illustrates a timing diagram for an implementation where a burner 108 of the combination boiler 100 is fired during operation. As illustrated in FIG. 18, at time0 the DHW output temperature T3 is below the pre-heat initialization temperature threshold T_ON. As such, a pre-heat operation of the combination boiler 100 is initiated. Because the PHE outlet temperature T2 is greater than the minimum outlet temperature threshold T_FIRE at time0, the burner 108 of the combination boiler 100 does not fire. The controller 120 of the combination boiler 100 is configured to circulate heated boiler loop water from the boiler loop through the secondary heat exchanger 116 at initiation of the pre-heat operation period. At time1 of FIG. 18, the PHE outlet temperature T2 drops below the minimum outlet temperature threshold T_FIRE. Because the PHE outlet temperature T2 falls below the minimum outlet temperature threshold T_FIRE during a pre-heat operation, the controller 120 causes the burner 108 to fire. After the burner 108 fires, at time2 illustrated by FIG. 18, the PHE outlet temperature T2 of the combination boiler 100 increases above the minimum outlet threshold T_FIRE.

After the burner 108 fires, and because water is circulating from the boiler loop through the secondary heat exchanger 116 during the pre-heat operation, each of the PHE inlet temperature T1, the PHE outlet temperature T2, and the DHW output temperature T3 increase after the pre-heat operation begins. At time3 of FIG. 18, the DHW output temperature T3 increases above the pre-heat initialization temperature threshold T_ON. The PHE outlet temperature T2 rises above the pre-heat cancellation temperature threshold T_OFF at time4 of FIG. 18. As such, the controller 120 causes the burner 108 to stop firing, and the PHE outlet temperature T2 decreases over time. At time5 of FIG. 18, the DHW draw is stopped, and each of the PHE inlet temperature T1, the PHE outlet temperature T2, and the DHW output temperature T3 slowly decrease over time, for example towards an ambient temperature. At time5 of FIG. 18, the PHE outlet temperature T2 falls below the minimum outlet temperature threshold T_FIRE. However, because a pre-heat operation has not initiated, the burner 108 is not caused to fire at the time that the PHE outlet temperature T2 falls below the minimum outlet temperature threshold T_FIRE.

At time6 of FIG. 18, the DHW output temperature T3 falls below the pre-heat initialization temperature threshold T_ON. Because at least one of the PHE inlet temperature T1 and the DHW output temperature T3 have fallen below the pre-heat initialization temperature threshold T_ON, the controller 120 begins a pre-heat operation of the combination boiler 100. At initiation of the pre-heat operation, heated boiler loop water is diverted and circulated through the secondary heat exchanger 106 via at least one of the flow diverted valve 114 and the inlet pump 104. The controller 120 is configured to control operations of at least one of the flow diverting valve 114 and the inlet pump 104 to cause the circulation of boiler loop water through the secondary heat exchanger 116. After a delay period associated with the pre-heat operation, at time7 of FIG. 18, the controller 120 causes circulation of the heated boiler loop water through the secondary heat exchanger 116 to begin. Each of the PHE inlet temperature T1, the PHE outlet temperature T2, and the DHW output temperature T3 increase as the water is recirculated, and because the PHE outlet temperature T2 is less than the minimum outlet temperature threshold T_FIRE, the controller 120 causes the burner 108 of the combination boiler 100 to fire.

At time8 of FIG. 18, the PHE inlet temperature T1 rises above the maximum outlet temperature threshold T_END. However, the pre-heat operation is not ended because both of the PHE inlet temperature T1 and the DHW output temperature T3 are required to exceed the maximum outlet temperature threshold T_END for the controller 120 to end a current pre-heat operation. Shortly after time8 of FIG. 18, the PHE outlet temperature T2 exceeds the pre-heat cancellation temperature threshold T_OFF, causing the controller 120 to end the current pre-heat operation and stop firing the burner 108. At time9 of FIG. 18, both of the PHE inlet temperature T1 and the DHW output temperature T3 are greater than the maximum outlet temperature threshold T_END, however, the pre-heat operation has previously ended based on the PHE outlet temperature exceeding the pre-heat cancellation temperature threshold T_OFF.

As described herein, a combination boiler 100 may monitor both a PHE inlet temperature T1 and a DHW output temperature T3 to determine when a pre-heat call is needed. When a pre-heat call is active, the inlet pump 104 of the boiler loop may run with the flow diverting valve 114 in a position to cause boiler loop water to flow between the primary heat exchanger 106 and the secondary heat exchanger 116. This enables heat energy to be transferred from the boiler loop to the domestic water loop as well as to be able to read the temperature of the water stored in the primary heat exchanger 106. Once a pre-heat operation has started, and after a short delay (e.g., to ensure the temperature of the water stored in the primary heat exchanger 106 can be read, the PHE outlet temperature sensor 112 is monitored to determine when the burner 108 needs to be fired in order to replenish the heat in the primary heat exchanger 106. During a pre-heat operation, but before the boiler has fired, the controller 120 of the combination boiler 100 also monitors both the DHW output temperature T3 and the PHE inlet temperature T1 to determine if the pre-heat operation can be ended before the boiler has had to fire. If the controller 120 determines that the burner 108 needs to fire for the pre-heat call, it will cause the burner 108 to ignite and be forced to low fire. The burner 108 may then run at low fire until the PHE outlet temperature T2 reaches a desired temperature. The PHE outlet temperature T2 may be monitored, for example, because this temperature represents a maximum possible temperature for the domestic water loop (e.g., because of heat transfer between the boiler loop and domestic loop), and has the least delay in measurement.

A combination boiler 100 may optionally be equipped with a space heating temperature sensor and can also compare that temperature to the desired storage temperature of the primary heat exchanger 106 (e.g., at the storage 107) and the controller 120 may change a position of the flow diverting valve 114 to a space heating position to take heat from the heating system, rather than causing the burner 108 to fire.

By monitoring both the PHE inlet temperature T1 and the DHW output temperature T3 to determine when to start a pre-heat call, the controller 120 is able to either periodically or non-periodically circulate water between the primary heat exchanger 106 and the secondary heat exchanger 116, as needed, in order to monitor the temperature of water stored at the primary heat exchanger 106. This can occur when the water at the location of the sensors has cooled to a certain point indicating the need to run the inlet pump 104, or if some other condition has caused one or more of the temperatures to drop below a particular value (e.g., TON).

By monitoring the DHW output temperature T3 specifically, the controller 120 is able to determine if a low DHW flow or circulation is present, as either would cause the DHW output temperature T3 to drop. In his case, the controller 120 may operate the inlet pump 104 and circulate water between the primary heat exchanger 106 and the secondary heat exchanger 116, thereby starting the transfer of heat energy to the domestic water loop. By handling these calls differently from a typical DHW draw, the controller 120 can use much less aggressive control methods to mitigate the risk of overshooting the desired temperature or short cycling the burner 108 in the event that it must fire.

By incorporating an outlet temperature differential to determine when to fire the burner 108, the run time of the burner 108 can be maximized thereby preventing rapid thermal cycling of the primary heat exchanger 106. This ensures that the burner 108 will only fire when it will be able to gain enough heat to run for an acceptable duration.

As described herein, systems and methods are provided for controlling a combination boiler. Various advantages are provided by implementing systems consistent with the present disclosure, including increased longevity of mechanical operation, decreased fuel expense, and decreased energy usage.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct connection between the connected items or an indirect connection through one or more passive or active intermediary devices.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A method of controlling a combination boiler, the combination boiler having a primary heat exchanger connected to a boiler loop, a burner configured to provide heat to the primary heat exchanger, and a secondary heat exchanger configured to transfer heat energy from the boiler loop to a domestic water loop, the method having steps comprising:

(a) storing heated water at the primary heat exchanger;

(b) obtaining a pre-heat initialization temperature threshold and a minimum outlet temperature threshold;

(c) monitoring a primary heat exchanger inlet temperature and a domestic hot water (DHW) output temperature;

(d) detecting at least one of the primary heat exchanger inlet temperature and the DHW output temperature falling below the pre-heat initialization temperature threshold;

(e) initiating a pre-heat operation of the combination boiler by circulating the heated water from the primary heat exchanger to the secondary heat exchanger;

(f) monitoring an outlet temperature of the primary heat exchanger; and (g) firing the burner when the outlet temperature falls below the minimum outlet temperature threshold.

2. The method of claim 1, further comprising:

obtaining a maximum outlet temperature threshold; and ending the pre-heat operation by stopping the burner from firing and stopping circulation of the heated water when the outlet temperature exceeds the maximum outlet temperature threshold.

3. The method of claim 2, further comprising:

obtaining a circulation time interval; and starting a circulation operation after the pre-heat operation has ended and a time period corresponding to the circulation time interval has expired.

4. The method of claim 3, wherein the circulation operation comprises:

outputting the heated water from the primary heat exchanger;

measuring a current temperature of the heated water; and determining a burner fire status based by comparing the current temperature to the minimum outlet temperature threshold.

5. The method of claim 1, wherein step (f) comprises:

obtaining an outlet measurement delay period;

initiating a time delay in accordance with the outlet measurement delay period when the pre-heat operation is initiated; and monitoring the outlet temperature after expiration of the delay period.

6. The method of claim 1, wherein the combination boiler includes a pump and a flow diverter valve, and wherein step (e) further comprises:

determining an estimated heat demand;

operating the pump to circulate water in the boiler loop; and at least one of measuring or adjusting a position of the flow diverter valve to ensure heated water flows from the primary heat exchanger to the secondary heat exchanger at a rate corresponding to the estimated heat demand.

7. The method of claim 1, further comprising:

receiving a boiler command having a higher priority than the pre-heat operation while the pre-heat operation is being performed;

interrupting the pre-heat operation and performing a prioritized operation corresponding to the boiler command; and resuming the pre-heat operation after the prioritized operation is completed.

8. The method of claim 7, further comprising:

obtaining a time period associated with the prioritized operation;

obtaining a maximum outlet temperature threshold; and continuing to fire the burner after resuming the pre-heat operation until at least one of:

(i) the time period expires; and (ii) the outlet temperature exceeds the maximum outlet temperature threshold.

* * * * *